US010411360B2

(12) United States Patent
Tanabe

(10) Patent No.: US 10,411,360 B2
(45) Date of Patent: Sep. 10, 2019

(54) PLANAR ANTENNA

(71) Applicant: NEC Corporation, Tokyo (JP)

(72) Inventor: Kosuke Tanabe, Tokyo (JP)

(73) Assignee: NEC CORPORATION, Minato-ku, Tokyo (JP)

( * ) Notice: Subject to any disclaimer, the term of this patent is extended or adjusted under 35 U.S.C. 154(b) by 71 days.

(21) Appl. No.: 15/520,120

(22) PCT Filed: Aug. 7, 2015

(86) PCT No.: PCT/JP2015/003994
§ 371 (c)(1),
(2) Date: Apr. 19, 2017

(87) PCT Pub. No.: WO2016/063438
PCT Pub. Date: Apr. 28, 2016

(65) Prior Publication Data

US 2017/0310016 A1 Oct. 26, 2017

(30) Foreign Application Priority Data

Oct. 21, 2014 (JP) ..... 2014-214459

(51) Int. Cl.
*H01Q 9/04* (2006.01)
*H01Q 13/20* (2006.01)
(Continued)

(52) U.S. Cl.
CPC ..... *H01Q 21/005* (2013.01); *H01Q 9/0407* (2013.01); *H01Q 13/20* (2013.01);
(Continued)

(58) Field of Classification Search
CPC .. H01Q 21/005; H01Q 9/0407; H01Q 21/061; H01Q 21/24; H01Q 15/242; H01Q 13/20; H01Q 21/06
(Continued)

(56) References Cited

U.S. PATENT DOCUMENTS 6,057,802 A * 5/2000 Nealy ..... H01Q 9/0407 343/700 MS
6,300,906 B1 * 10/2001 Rawnick ..... H01Q 1/38 343/700 MS
(Continued)

FOREIGN PATENT DOCUMENTS

CN 102110884 A 6/2011
CN 103985970 A 8/2014
(Continued)

OTHER PUBLICATIONS

Communication dated Oct. 16, 2017 issued by the European Patent Office in counterpart application No. 15853361.2.
(Continued)

*Primary Examiner* — Khai M Nguyen
(74) *Attorney, Agent, or Firm* — Sughrue Mion, PLLC

(57) ABSTRACT

A planar antenna according to the present invention includes a plurality of antenna elements arranged thereon and characterized in that two opposite corner parts from among corners of an N-gon (N is an even number equal to or greater than four) are cut out. For example, a planar antenna has a shape in which two opposite corner parts from among four corner parts included in a rectangle (11) (N=4) are cut out. The planar antenna may be composed by combining a plurality of square antenna units on which a plurality of antenna elements are arranged.

5 Claims, 24 Drawing Sheets

(51) Int. Cl.

| | |
|---|---|
| ***H01Q 15/24*** | (2006.01) |
| ***H01Q 21/00*** | (2006.01) |
| ***H01Q 21/06*** | (2006.01) |
| ***H01Q 21/24*** | (2006.01) |

(52) U.S. Cl.
CPC ..... *H01Q 15/242* (2013.01); *H01Q 21/06* (2013.01); *H01Q 21/061* (2013.01); *H01Q 21/24* (2013.01)

(58) Field of Classification Search
USPC ..... 343/700 MS, 771, 853, 824, 893
See application file for complete search history.

(56) References Cited

U.S. PATENT DOCUMENTS

| | | | | |
|---|---|---|---|---|
| 6,798,384 | B2 * | 9/2004 | Aikawa | H01Q 13/106 343/700 MS |
| 7,227,500 | B2 * | 6/2007 | Oshima | H01Q 1/1271 343/700 MS |
| 7,369,088 | B2 * | 5/2008 | Kushihi | H01Q 9/0428 343/700 MS |
| 8,564,484 | B2 * | 10/2013 | Jan | H01Q 9/0414 343/700 MS |
| 9,013,361 | B1 * | 4/2015 | Lam | H01Q 21/061 343/824 |
| 2010/0001906 | A1 | 1/2010 | Akkermans et al. | |

FOREIGN PATENT DOCUMENTS

| | | | |
|---|---|---|---|
| JP | 5-291814 | A | 11/1993 |
| JP | 9-51225 | A | 2/1997 |
| JP | 9-72952 | A | 3/1997 |
| JP | 11-88044 | A | 3/1999 |
| JP | 2010-16789 | A | 1/2010 |
| JP | 2010-41700 | A | 2/2010 |
| WO | 2006/061865 | A1 | 6/2006 |

OTHER PUBLICATIONS

International Search Report of PCT/JP2015/003994, dated Oct. 27, 2015. [PCT/ISA/210].

* cited by examiner

PLANAR ANTENNA

CROSS REFERENCE TO RELATED APPLICATIONS

This application is a National Stage of International Application No. PCT/JP2015/003994 filed Aug. 7, 2015, claiming priority based on Japanese Patent Application No. 2014-214459, filed Oct. 21, 2014, the contents of all of which are incorporated herein by reference in their entirety.

TECHNICAL FIELD

The present invention relates to a planar antenna, and in particular, to a planar antenna on which a plurality of antenna elements are arranged.

BACKGROUND ART

In communication using microwaves, parabola antennas or planar antennas with directivity are used. Particularly in recent years, planar antennas that can be installed in a space smaller than spaces where parabolic antennas are installed have been attracting attention.

Patent Literature 1 discloses a technique relating to a planar radar that can reduce the number of antenna elements (antenna units) while preventing sidelobe characteristics from deteriorating. In the planar radar disclosed in Patent Literature 1, the antenna units are arranged in a cross shape.

Patent Literature 2 discloses a technique relating to a planar antenna capable of achieving low sidelobe directional characteristics without lowering a gain.

CITATION LIST

Patent Literature

Patent Literature 1: Japanese Unexamined Patent Application Publication No. 9-72952

Patent Literature 2: Japanese Unexamined Patent Application Publication No. 2010-41700

SUMMARY OF INVENTION

Technical Problem

In a planar antenna on which a plurality of antenna elements are arranged, the number of antenna elements commonly increases by a power of two for reasons such as ease of designing feeder circuits. In this case, a gain of the planar antenna becomes discrete. In order to adjust the gain of the planar antenna that changes discretely in this way, it is necessary to adjust the number of antenna elements. However, there is a problem that characteristics of the planar antenna (in particular, the sidelobe characteristics) deteriorate unless the number of the antenna elements is properly adjusted. For example, in a planar radar disclosed in Patent Literature 1, the antenna units (antenna elements) are arranged in the cross shape. However, when the antenna units (antenna elements) are arranged in a cross shape in this manner, antenna characteristics deteriorate (see FIGS. 20A, 20B, 21A and 21B).

In light of the above problem, an object of the present invention is to provide a planar antenna capable of adjusting a gain of the antenna while maintaining sidelobe characteristics.

Solution to Problem

An example aspect of the present invention is a planar antenna that includes a plurality of antenna elements arranged thereon. Two opposite corner parts from among corners of an N-gon (N is an even number equal to or greater than four) are cut out.

Another example aspect of the present invention is a planar antenna on which a plurality of antenna elements are arranged. A shape of the planar antenna is an octagon having six internal angles of 90 degrees and two internal angles of 270 degrees.

Still another aspect of the present invention is a planar antenna on which a plurality of antenna elements are arranged. The planar antenna has a shape in which a central part of a rectangle is hollowed out by a rectangle.

Advantageous Effects of Invention

According to the present invention, it is possible to provide a planar antenna capable of adjusting a gain of the antenna while maintaining sidelobe characteristics.

DESCRIPTION OF EMBODIMENTS

Figure 1:
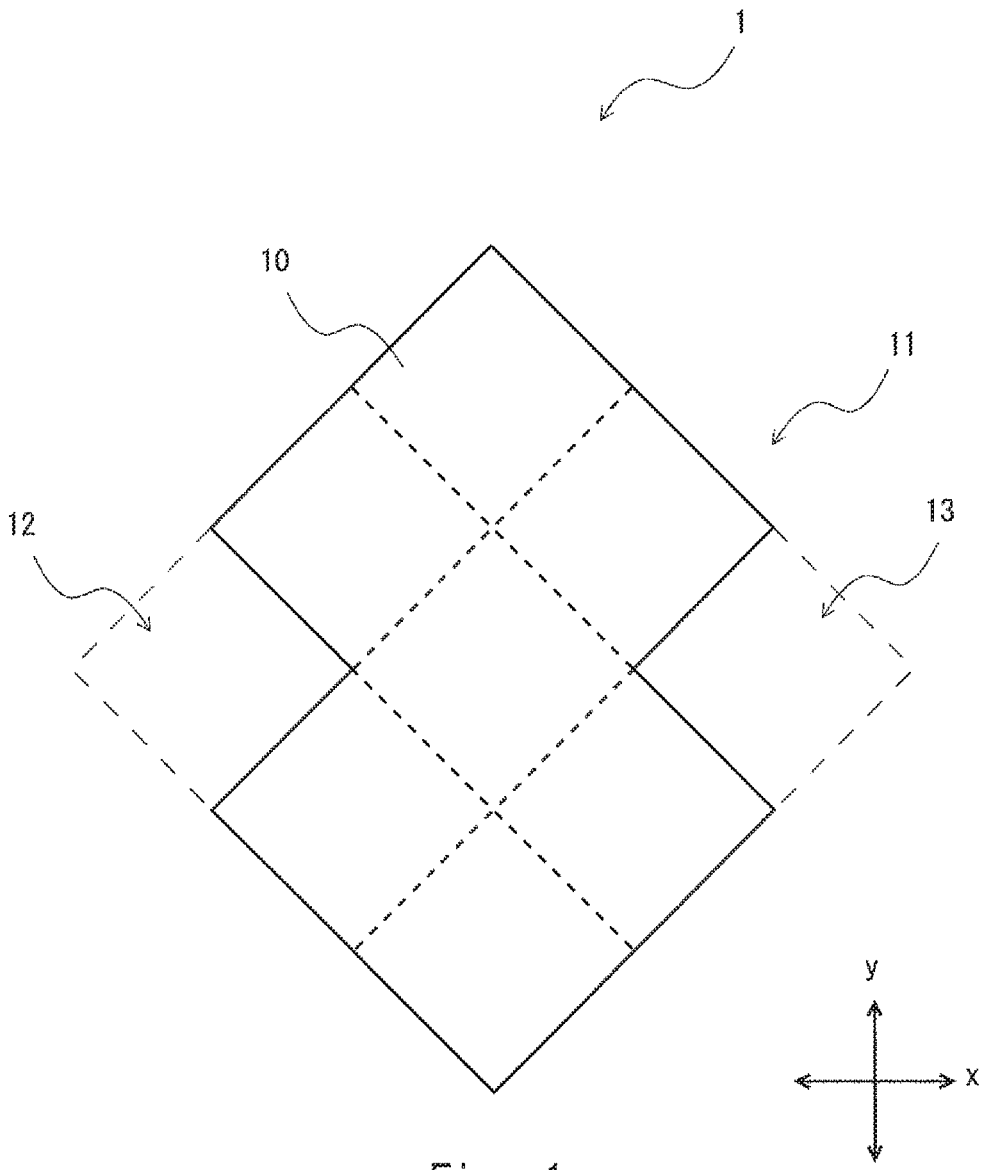
FIG. 1 is a plan view showing a planar antenna according to an embodiment.
Figure 2:
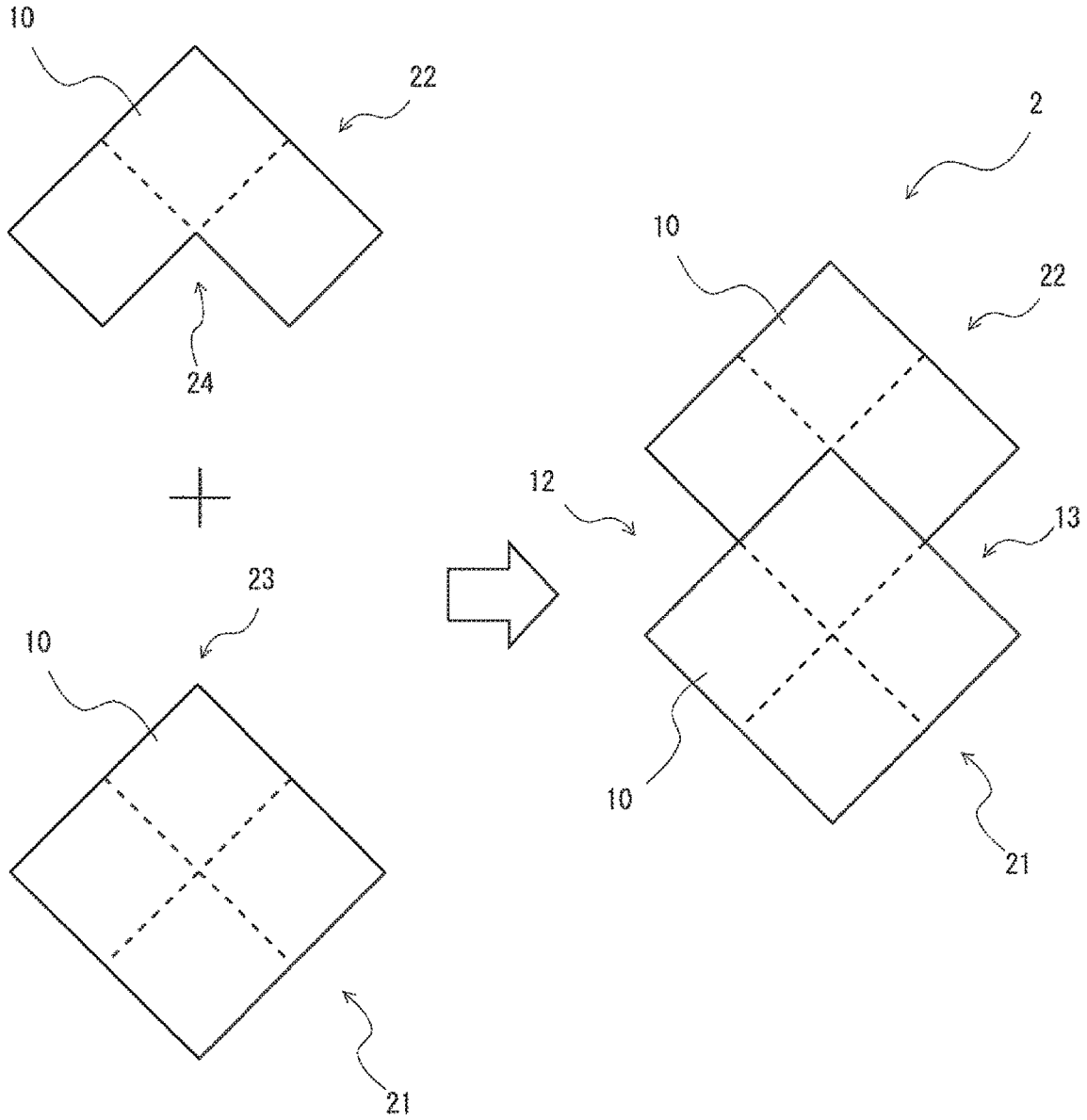
FIG. 2 is a plan view showing another aspect of the planar antenna according to the embodiment.
Figure 3:
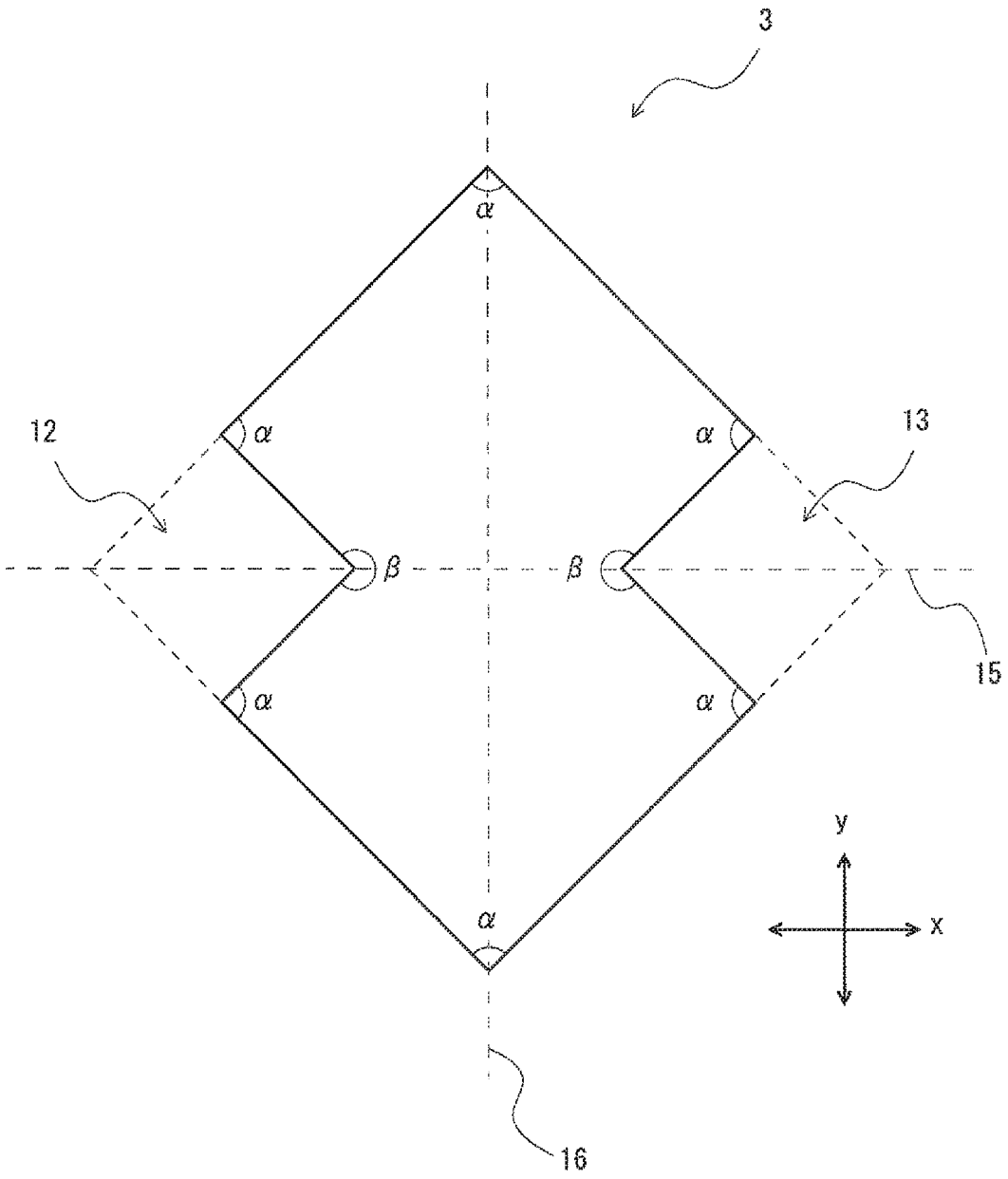
FIG. 3 is a plan view showing another aspect of the planar antenna according to the embodiment.
Figure 5:
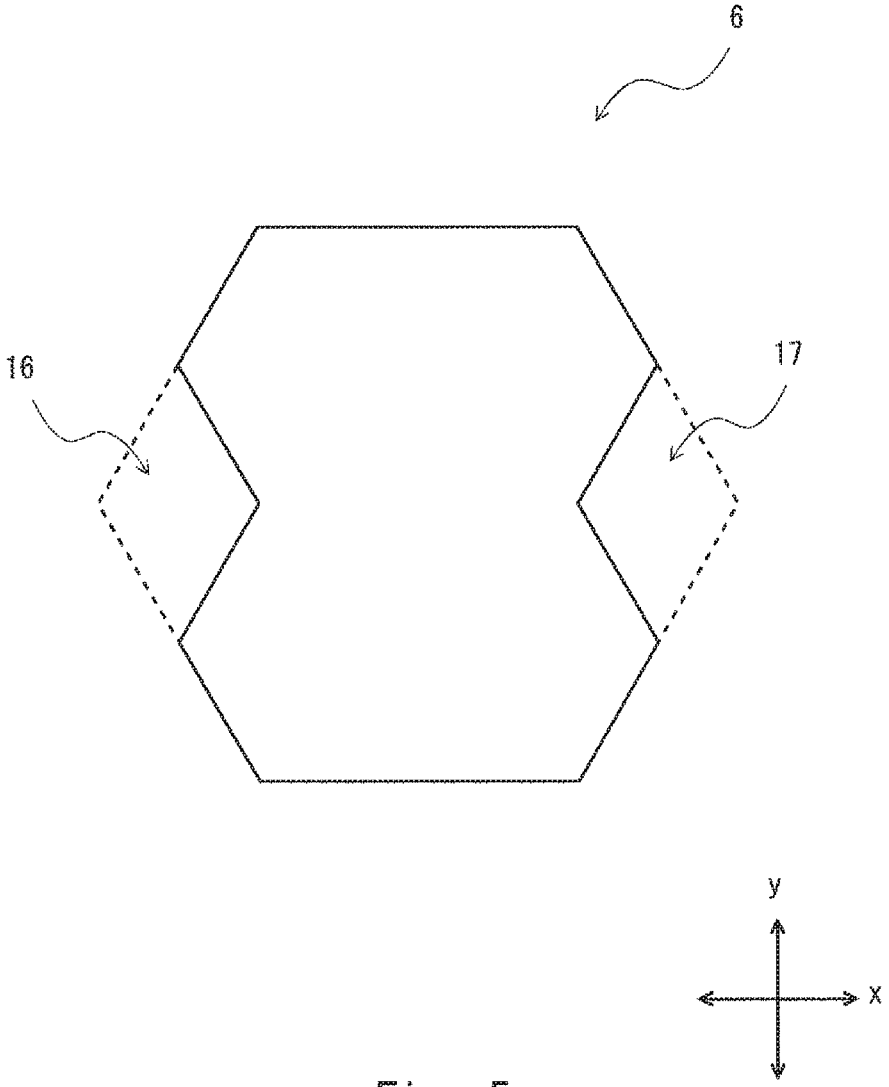
FIG. 5 is a plan view showing another aspect of the planar antenna according to the embodiment.

Hereinafter, an embodiment of the present invention will be described with reference to the drawings. A planar antenna according to the present invention is a planar antenna on which a plurality of antenna elements are arranged, where two opposite corner parts of an N-gon (N is an even number equal to or greater than four) from among corner parts are cut out. In this case, the N-gon is a polygon such as a rectangle, a hexagon, an octagon, or the like. In FIGS. 1 to 3, two opposite corner parts from among the corner parts are cut out. FIG. 5 shows a case where two opposite corner parts from among corner parts of a hexagon are cut out. Hereinafter, the planar antenna according to this embodiment will be described in detail.

FIG. 1 is a plan view showing a planar antenna according to this embodiment. As shown in FIG. 1, the planar antenna 1 has a shape in which two opposite corner parts 12 and 13 from among four corner parts included in a rectangle 11 (i.e., outer periphery including the broken lines in FIG. 1) are cut out. To be more specific, the planar antenna 1 has a shape in which the two corner parts 12 and 13 opposed in the horizontal direction (x-axis direction) from among the four corner parts included in the rectangle 11 (rectangle whose respective diagonal lines are arranged in parallel to the x-axis direction and y-axis direction, respectively) are cut out into rectangular shapes, respectively. The horizontal direction (x-axis direction) corresponds to an amplitude direction of horizontal polarized waves. The vertical direction (y-axis direction) corresponds to an amplitude direction of vertical polarized waves.

For example, the planar antenna 1 can be composed by combining a plurality of square antenna units 10 on which a plurality of antenna elements 32 (see FIG. 4A) are arranged. The planar antenna 1 shown in FIG. 1 is composed by combining seven antenna units 10.

Further, in this embodiment, as shown in a planar antenna 2 in FIG. 2, the planar antenna may be composed by combining a first unit 21 including four antenna units 10 arranged in a square shape and a second unit 22 including three antenna units 10 arranged in an L shape. In this case, a recessed part 24 of the second unit 22 is arranged so as to be joined with one corner part 23 of the first unit 21. The planar antenna 2 shown in FIG. 2, like the planar antenna 1 shown in FIG. 1, has a shape in which the two corner parts 12 and 13 opposed in the horizontal direction (x-axis direction) from among the four corner parts included in the rectangle 11 are cut out into rectangular shapes, respectively.

In this embodiment, the configuration is not limited to the configuration in which the plurality of antenna units 10 are combined like the planar antennas 1 and 2 shown in FIGS. 1 and 2, respectively. For example, a planar antenna may be integrally formed like a planar antenna 3 shown in FIG. 3. That is, the planar antenna may be composed of one antenna unit. By composing the planar antenna of one antenna unit in this manner, it is possible to eliminate joints between the antenna units and to improve the strength of the planar antenna.

Describing the planar antenna according to this embodiment in other words, as shown in FIG. 3, the planar antenna has an octagonal shape having six internal angles $\alpha$ of 90 degrees and two internal angles $\beta$ of 270 degrees. In this case, the octagon is axisymmetric with respect to two symmetrical axes 15 and 16. The two symmetrical axes 15 and 16 are orthogonal to each other.

Figure 4A:
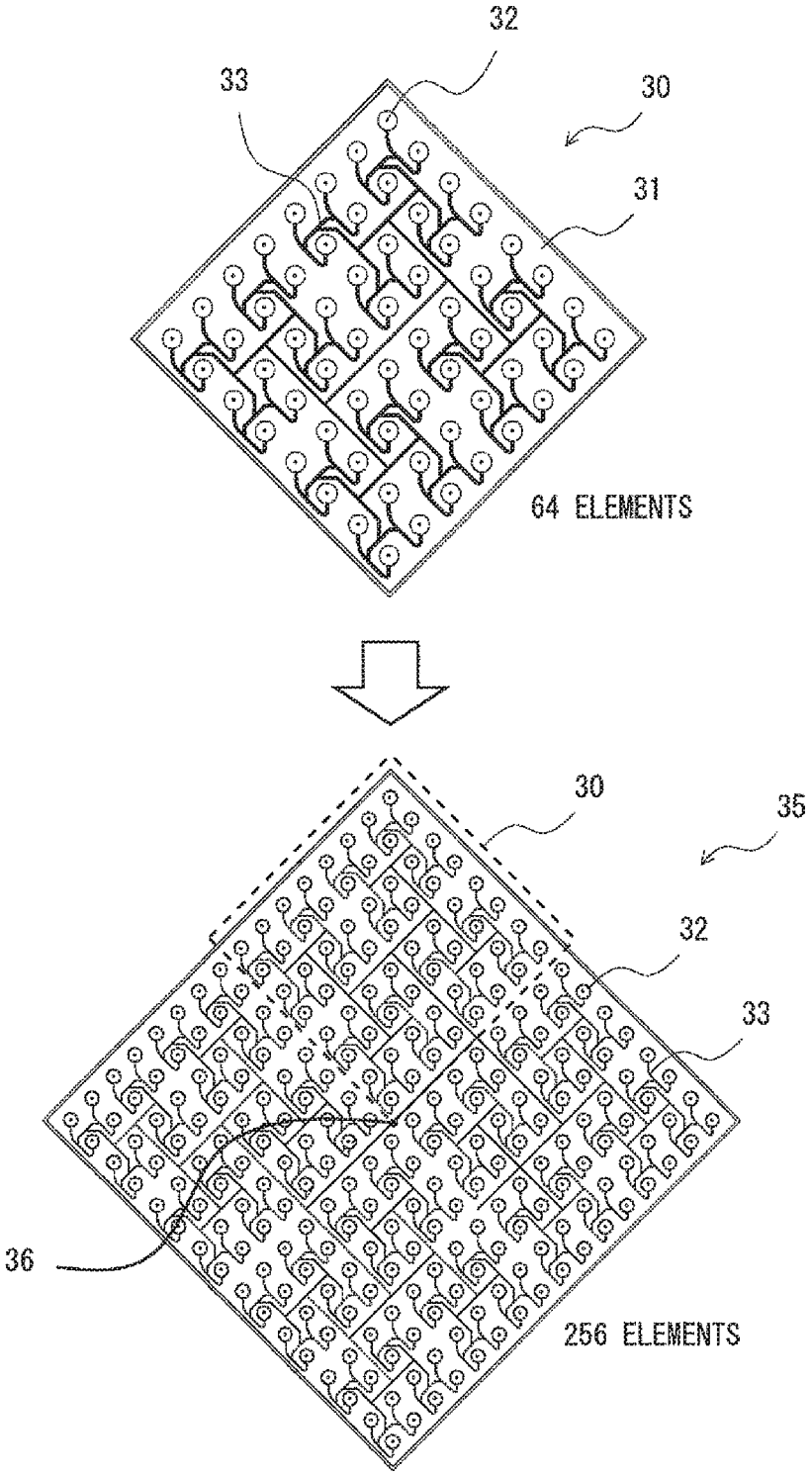
FIG. 4A is a plan view showing an example of feeder circuits included in the planar antenna according to the embodiment.
Figure 4B:
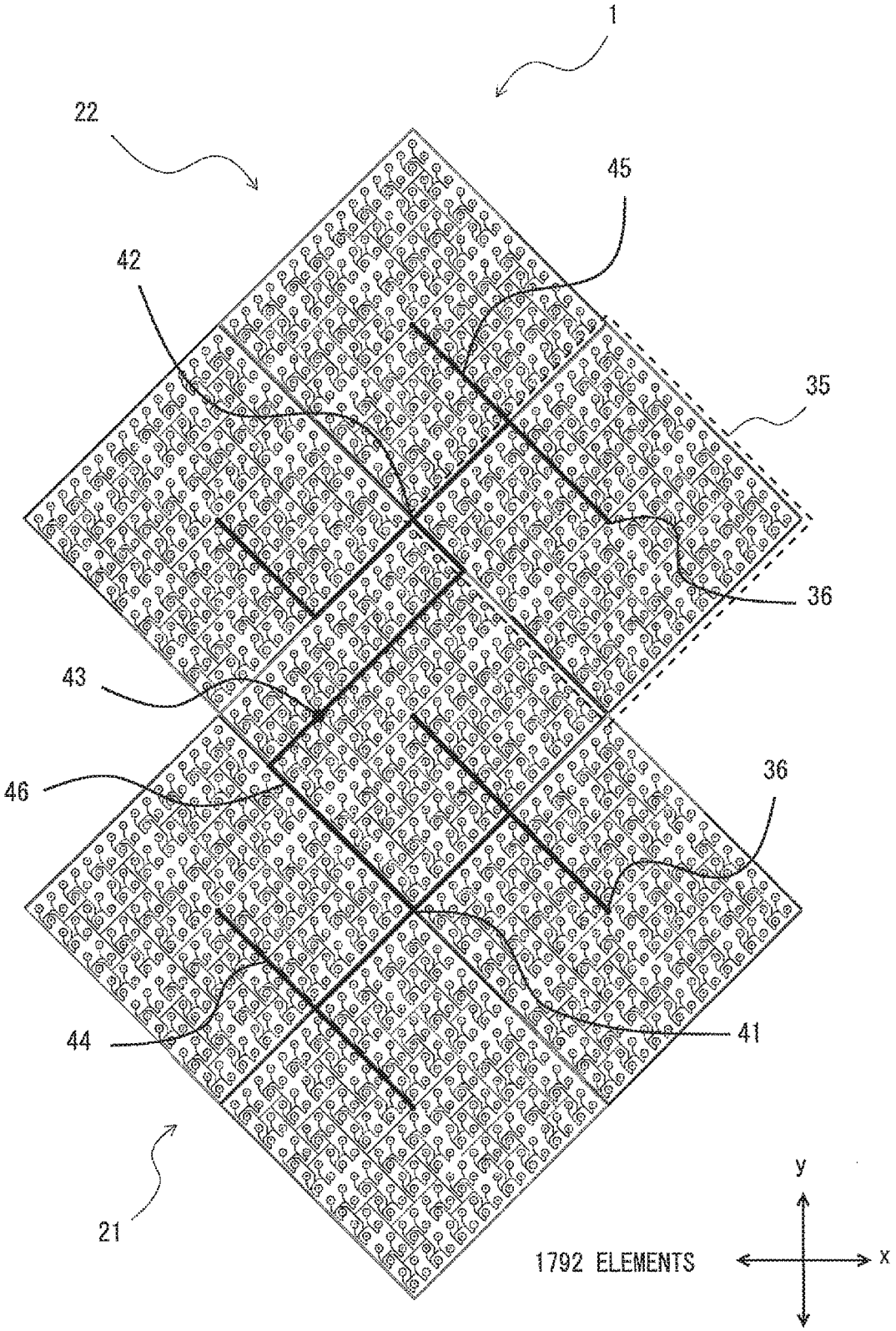
FIG. 4B is a plan view showing an example of the feeder circuits included in the planar antenna according to the embodiment.

FIGS. 4A and 4B are plan views showing examples of feeder circuits included in the planar antenna 1 according to this embodiment. As shown in the upper drawing of FIG. 4A, an antenna unit 30 includes a plurality of antenna elements 32 (micro strip antennas). The antenna elements 32 are arranged in a lattice pattern on a dielectric substrate 31. Specifically, the antenna elements 32 are arranged so as to be parallel to four sides of the antenna unit 30. The antenna elements 32 are electrically connected by using microstrip lines (feeder circuits) 33. For example, the microstrip lines (feeder circuits) 33 are formed on the same layer on which the antenna elements 32 are formed.

The antenna unit 30 shown in the upper drawing of FIG. 4A has 64 antenna elements 32. An antenna unit 35 shown in the lower drawing of FIG. 4A can be composed by combining the four antenna units 30. The antenna unit 35 includes 256 elements (64 elements×4) of antenna elements 32. The antenna elements 32 are electrically connected by using microstrip lines (feeder circuits). That is, the antenna elements 32 having 256 elements included in the antenna unit 35 are electrically connected to a contact point 36 by using the microstrip lines (feeder circuits) 33.

Further, as shown in FIG. 4B, the planar antenna 1 can be composed by combining seven antenna units 35. The planar antenna 1 includes 1792 elements (256 elements×7) of antenna elements 32. The contact points 36 of the respective antenna units 35 are connected by using microstrip lines (feeder circuits) 44 and 45.

That is, in the first unit 21 (see FIG. 2) in which the four antenna units 35 are arranged in a square shape, the contact points 36 of the four antenna units 35 are connected by using the microstrip line (feeder circuit) 44. In other words, the contact points 36 of the four antenna units 35 are electrically connected to a contact point 41 by using the microstrip line (feeder circuit) 44.

Further, in the second unit 22 (see FIG. 2) in which the three antenna units 35 are arranged in the L shape, the contact points 36 of the three antenna units 35 are connected by using the microstrip line (feeder circuits) 45. In other words, the contact point 36 of the three antenna units 35 is electrically connected to a contact point 42 by using the microstrip line (feeder circuit) 45.

Further, the contact point 41 of the first unit 21 and the contact point 42 of the second unit 22 are connected by using a line 46. For example, the line 46 is formed on a layer different from a layer on which the antenna elements 32 and micro strip line (feeder circuit) 33 are formed. In this case, a point that is at the same distance from the contact point 41 of the first unit 21 as its distance from the contact point 42 of the second unit 22 is a feeding point 43.

The arrangement of the antenna elements 32 and the number of elements of the antenna elements 32 shown in FIGS. 4A and 4B are merely examples, and the planar antenna according to this embodiment may have other configurations. In FIGS. 4A and 4B, although the planar antenna including the antenna elements and the micro strip lines (feeder circuits) have been described, the invention according to this embodiment may be applied to other planar antennas. For example, the invention according to this embodiment can also be applied to a planar antenna in which the antenna elements are composed of slot antennas and feeder circuits are composed of waveguide circuits.

In the above description, the case where the rectangle 11 is a square has been described. However, in the planar antenna according to this embodiment, the rectangle 11 may be a rhombus.

FIG. 5 is a plan view showing another aspect of the planar antenna according to this embodiment. In a planar antenna 6 shown in FIG. 5, two opposite corner parts 17 and 18 from among corner parts of a hexagon are cut out. Even if the two corner parts 17 and 18 of the hexagon are cut out in this way, the same effect as in the case where the corner parts 12 and 13 of the rectangle are cut out can be achieved.

Figure 6A:
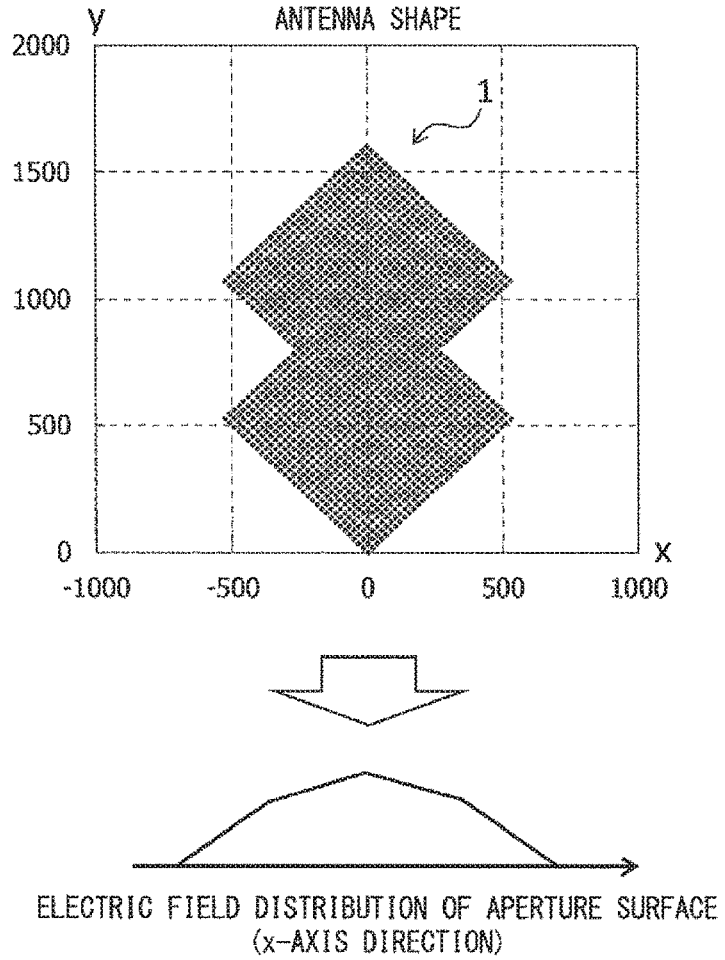
FIG. 6A is a drawing showing a shape of the planar antenna and an electric field distribution of an aperture surface of the planar antenna.
Figure 6B:
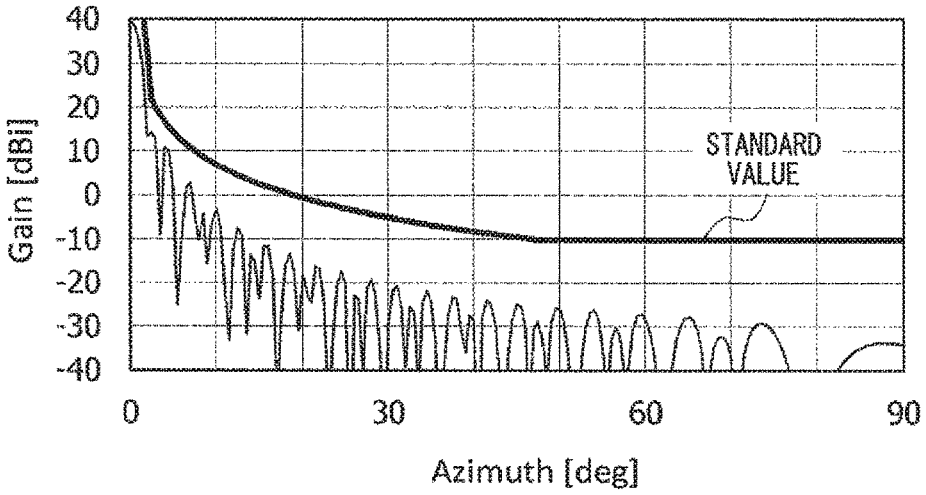
FIG. 6B is a drawing showing sidelobe characteristics of the planar antenna shown in FIG. 6A.

FIG. 6A is a drawing showing the shape of the planar antenna (corresponding to the planar antenna 1 shown in FIG. 1) and an electric field distribution (x-axis direction) of an aperture surface of the planar antenna. FIG. 6B is a drawing showing the sidelobe characteristics of the planar antenna shown in FIG. 6A. As shown in FIG. 6A, in the planar antenna 1 shown in FIG. 1, the electric field distribution (x-axis direction) of the aperture surface becomes low at both ends in the x-axis direction (i.e., tapered distribution). As for the sidelobe characteristics, the gain is lower than a standard value at radiation angles from 0 to 90 degrees. Therefore, the planar antenna 1 shown in FIG. 1 has good sidelobe characteristics.

Next, a case where an area of the cut-out in the corner parts 12 and 13 of the planar antenna 1 shown in FIG. 1 is changed will be described. In the following description, the cut-out corner parts 12 and 13 are also referred to as cut-out parts 12 and 13, respectively.

Figure 7A:
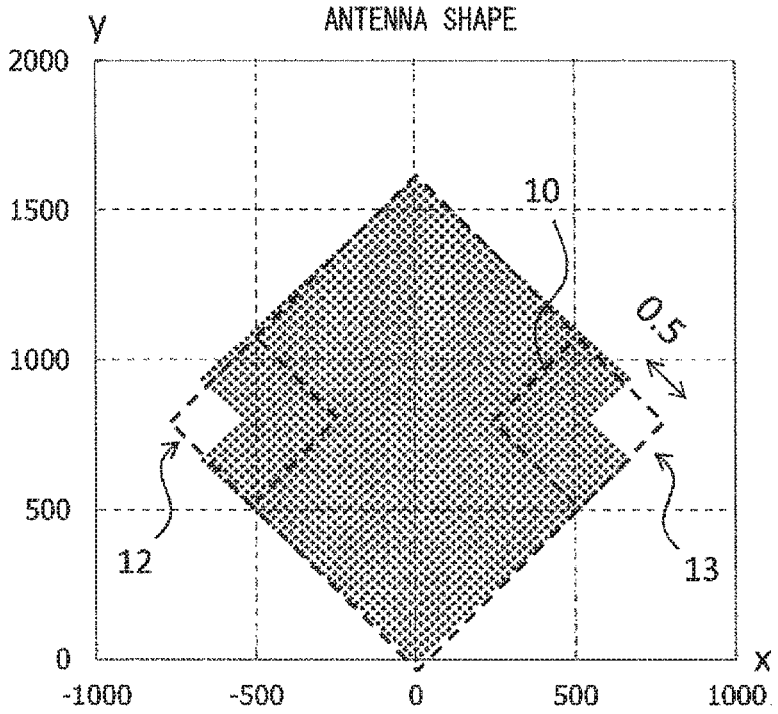
FIG. 7A is a drawing showing a shape of the planar antenna.
Figure 7B:
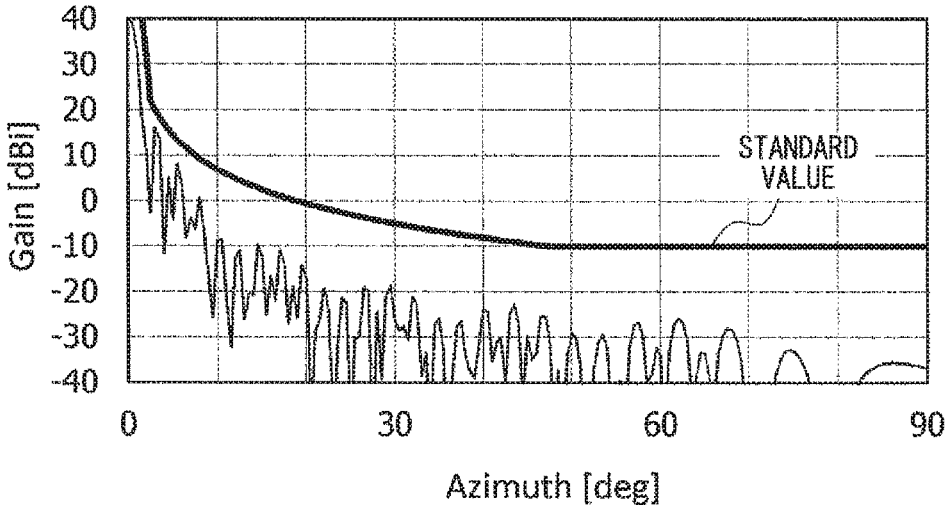
FIG. 7B is a drawing showing sidelobe characteristics of the planar antenna shown in FIG. 7A.

As shown in FIG. 7A, when the areas of the cut-out parts 12 and 13 of the planar antenna are reduced to ¼ of the area of the antenna unit 10, the sidelobe characteristics shown in FIG. 7B are obtained. That is, in this case, the sidelobe characteristics slightly deteriorate as compared with the case shown in FIG. 6B, but the gain is lower than the standard value at the radiation angles 0 to 90 degrees, and therefore good sidelobe characteristics are obtained.

In this example, when one side of the antenna unit 10 (square) is considered to be 1, one side of the cut-out parts 12 and 13 (squares) is 0.5. In other words, each of the cut-out parts 12 and 13 has an area 1/36 of the area of the square composed of nine antenna units 10 that are arranged.

Figure 8A:
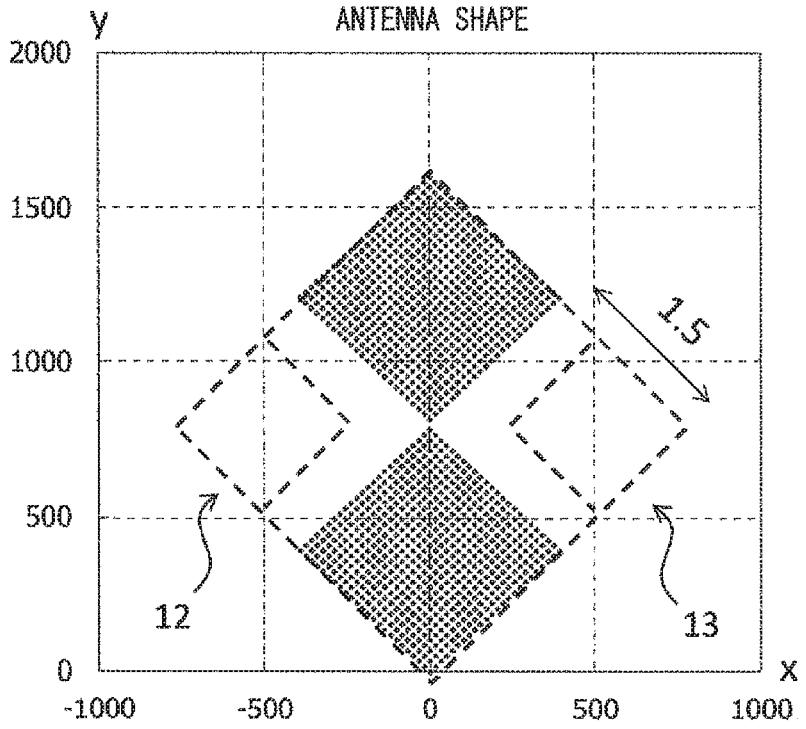
FIG. 8A is a drawing showing a shape of the planar antenna.
Figure 8B:
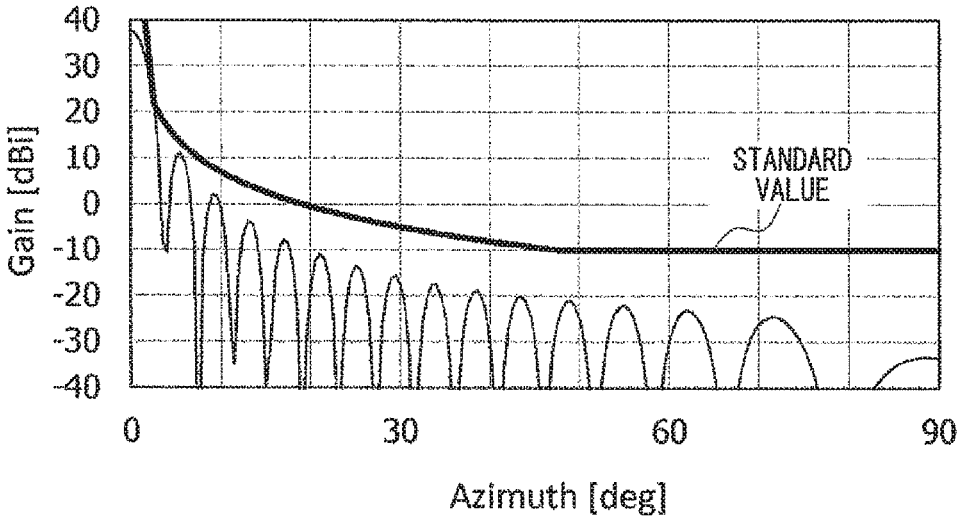
FIG. 8B is a drawing showing sidelobe characteristics of the planar antenna shown in FIG. 8A.

Further, as shown in FIG. 8A, when the areas of the cut-out parts 12 and 13 of the planar antenna are configured to be 9/4 of the area of the antenna unit 10, the sidelobe characteristics shown in FIG. 8B are obtained. That is, in this case, the sidelobe on the low angle side rises and the characteristics deteriorate. This is caused by the reduced area of the planar antenna.

In this example, when one side of the antenna unit 10 (square) is considered to be 1, one side of the cut-out parts 12 and 13 (squares) is 1.5. In other words, each of the cut-out parts 12 and 13 has an area ¼ of the area of the square composed of nine antenna units 10 that are arranged.

Based on the results shown in FIGS. 7B and 8B it is preferable to configure the planar antenna according to this embodiment in such a way that the areas of the cut-out parts 12 and 13 (second squares) will each become 1/36 or greater and 1/9 or less of the area of the square (first square) composed of nine antenna units 10 that are arranged. An upper limit value of the area of each of the cut-out parts 12 and 13 corresponds to the area of one antenna unit 10.

As described in the Background Art, parabola antennas and planar antennas with directivity are used in communication using microwaves. Particularly in recent years, planar antennas that can be installed in a space smaller than spaces where parabolic antennas are installed are attracting attention. At this time, in order to effectively use frequencies, planar antennas that can use both horizontal polarized waves and vertical polarized waves are required. For example, a square planar antenna whose two diagonal lines are arranged parallel to the horizontal direction and the vertical direction, respectively, has been used (see FIGS. 15 and 15A and 23A). In such a square planar antenna, antenna elements are arranged in a lattice pattern. Therefore, such a planar antenna is designed in such a way that the number of antenna elements will increase by a power of two for reasons such as ease of designing feeder circuits. Thus a gain of the planar antenna becomes discrete.

Figure 9:
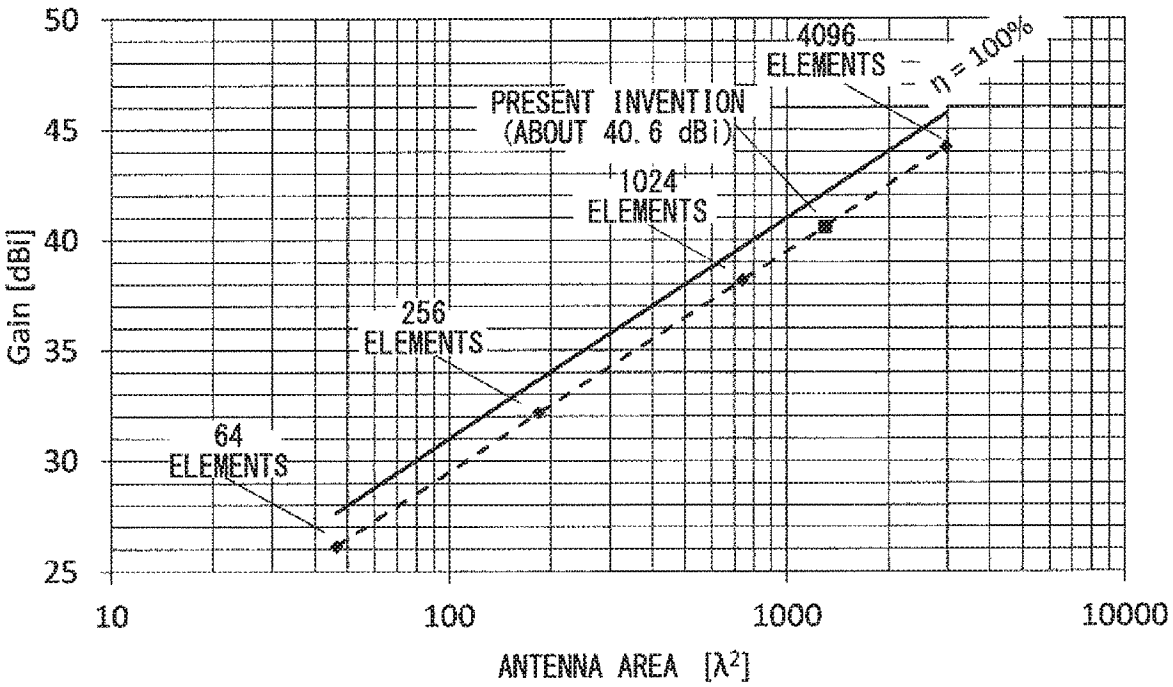
FIG. 9 is a drawing showing a relationship between an antenna area and a gain of a planar antenna.

FIG. 9 is a drawing showing a relation between an antenna area and a gain of a planar antenna. As shown in FIG. 9, in the square planar antenna, the number of antenna elements varies discretely, such as 64 elements, 256 elements, 1024 elements, and 4096 elements. Thus, the gain of the square planar antenna also varies discretely (e.g., varies by 6 dB). The broken line shown in FIG. 9 represents the gain of the planar antenna when gaps between the antenna elements are each assumed to be 0.85λ and an aperture efficiency of the planar antenna is assumed to be −1.5 dB.

As described above, when the planar antenna is designed in such a way that the number of antenna elements increases by a power of two, a design value for the number of the antenna elements of the planar antenna following the planar antenna having 1024 elements is 4096 elements. That is, in order to satisfy the gain of, for example, 40 dBi, it has been necessary to use the planar antenna having 4096 elements. Thus, in some cases, the characteristics of the planar antenna are overspecified, and the cost of the planar antenna increases. Therefore, in order to obtain a square planar antenna (between 1024 and 4096 elements) having a gain of, for example, 40 dBi, it has been necessary to appropriately adjust the number of antenna elements.

However, when the gain of the planar antenna is adjusted, there has been a problem that the number of antenna elements needs to be appropriately adjusted or the characteristics (in particular, the sidelobe characteristics) will deteriorate. For example, in the planar radar disclosed in Patent Literature 1, the antenna units (antenna elements) are arranged in the cross shape. However, if the antenna units (antenna elements) are arranged in the cross shape in this way, the antenna characteristics will deteriorate (see FIGS. 20A, 20B, 21A and 21B).

Therefore, in the invention according to this embodiment, the planar antenna 1 is configured in a shape in which the two opposite corner parts of the N-gon (N is an even number equal to or greater than four) from among the corner parts are cut out. For example, as shown in FIG. 1, the planar antenna 1 has a shape in which the two opposite corner parts 12 and 13 from among the four corner parts included in the rectangle 11 are cut out. By providing the cut-out parts in this way, the number of antenna elements can be adjusted (i.e., the number of the antenna elements can be reduced) to thereby adjust the gain of the planar antenna. At this time, in the invention according to this embodiment, since the two opposite corner parts from among the corners of the N-gon (N is an even number equal to or greater than four) are cut out, it is possible to prevent the sidelobe characteristics from deteriorating (see FIGS. 6A and 6B). Moreover, as the number of antenna elements can be reduced while satisfying the necessary antenna gain, it is possible to manufacture the planar antenna at low cost.

According to the invention of this embodiment described above, it is possible to provide a planar antenna capable of adjusting the gain of the antenna while maintaining the sidelobe characteristics.

Next, a modified example of the present invention will be described.

Figure 10A:
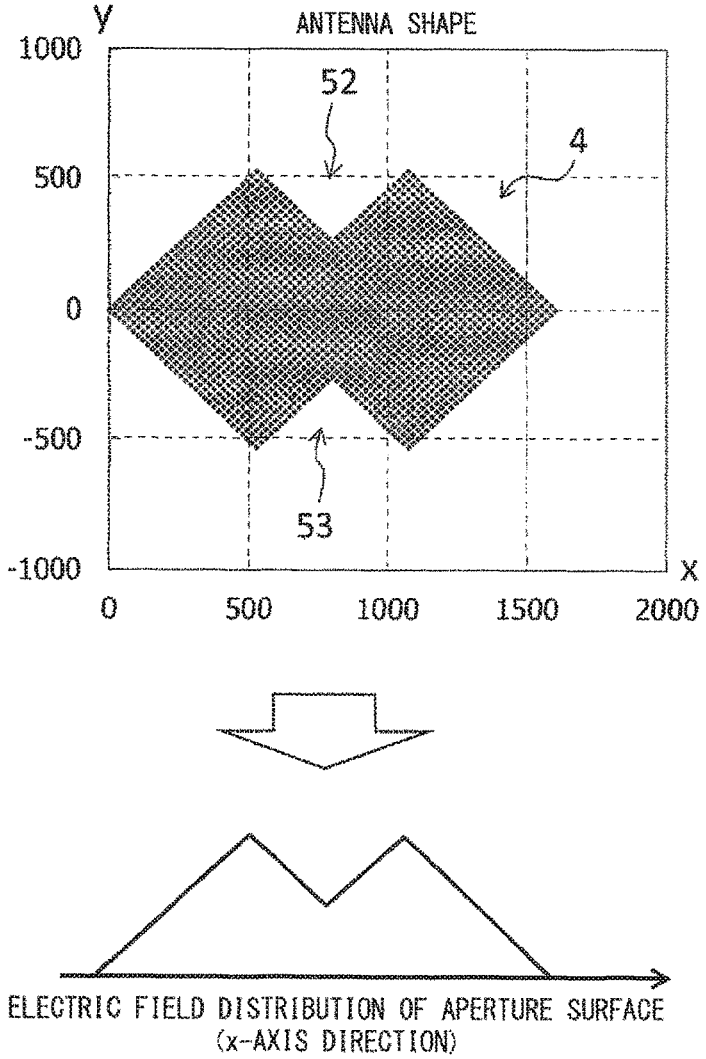
FIG. 10A is a drawing showing a shape of the planar antenna and an electric field distribution of an aperture surface of the planar antenna.

In this embodiment, as shown in FIG. 10A, a planar antenna 4 may be configured in a shape in which two corner parts 52 and 53 opposed in the vertical direction from among four corner parts included in a rectangle are cut out into rectangular shapes, respectively. In other words, the planar antenna 4 may have a shape obtained by rotating the planar antenna 1 shown in FIG. 1 by 90 degrees.

Figure 10B:
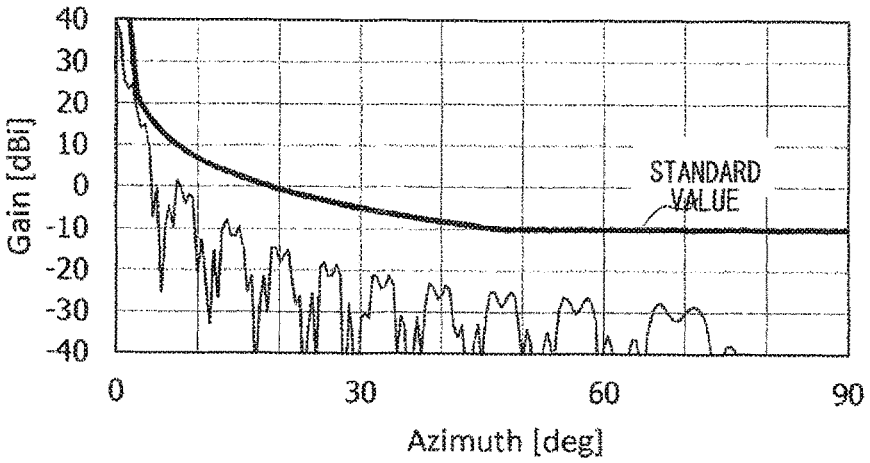
FIG. 10B is a drawing showing sidelobe characteristics of the planar antenna shown in FIG. 10A.

As shown in FIG. 10A, the electric field distribution (x-axis direction) of the aperture surface of the planar antenna 4 becomes low at both ends and at the center in the x-axis direction. As for the sidelobe characteristics shown in FIG. 10B, the gain is lower than the standard value at radiation angles from 0 to 90 degrees. Therefore, good sidelobe characteristics are obtained.

Next, a case where an area of the cut-out in the corner parts 52 and 53 of the planar antenna 4 shown in FIG. 10A is changed will be described. In the following description, the cut-out corner parts 52 and 53 are also referred to as cut-out parts 52 and 53, respectively.

Figure 11A:
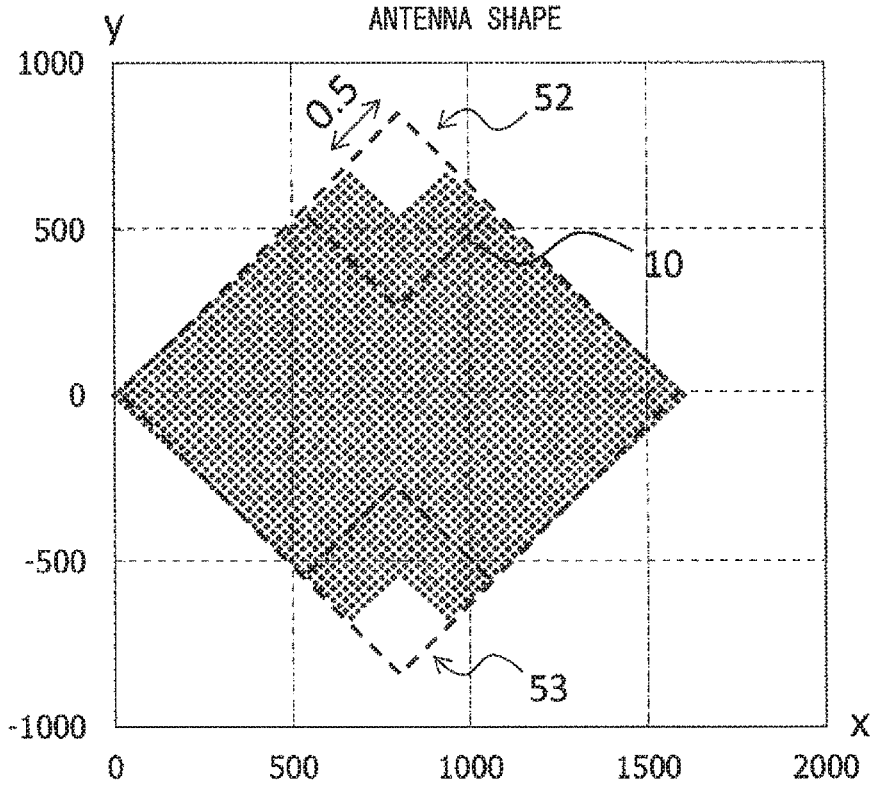
FIG. 11A is a drawing showing a shape of the planar antenna.
Figure 11B:
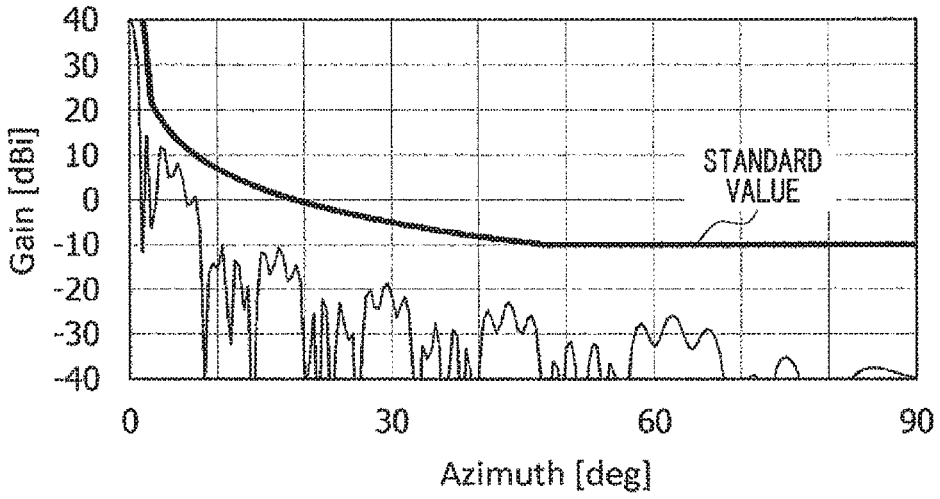
FIG. 11B is a drawing showing sidelobe characteristics of the planar antenna shown in FIG. 11A.

As shown in FIG. 11A, when the areas of the cut-out parts 52 and 53 of the planar antenna are reduced to ¼ of the area of the antenna unit 10, the sidelobe characteristics as shown in FIG. 11B are obtained. That is, in this case, the sidelobe characteristics slightly deteriorate as compared with the case shown in FIG. 10B, but the gain is lower than the standard value at the radiation angles θ to 90 degrees. Therefore good sidelobe characteristics are obtained.

In this example, when one side of the antenna unit 10 (square) is considered to be 1, one side of the cut-out parts 52 and 53 (squares) is 0.5. In other words, each of the cut-out parts 52 and 53 has an area 1/36 of the area of the square composed of nine antenna units 10 that are arranged.

Figure 12A:
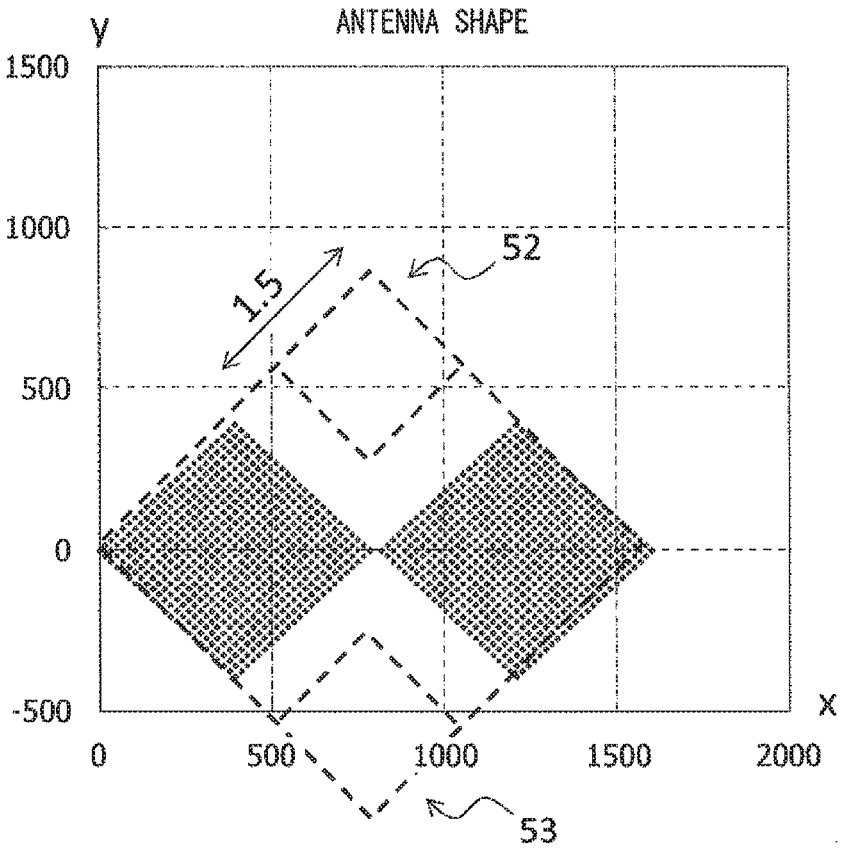
FIG. 12A is a drawing showing a shape of the planar antenna.
Figure 12B:
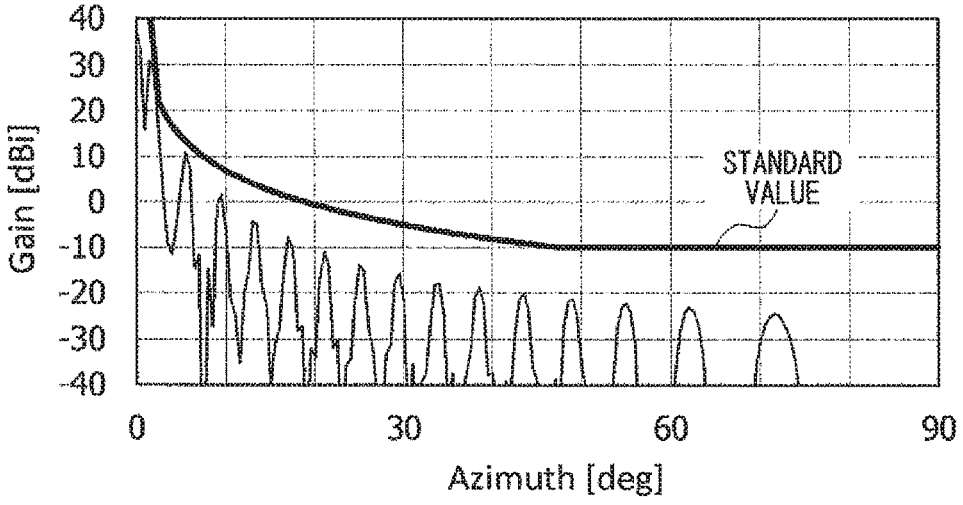
FIG. 12B is a drawing showing sidelobe characteristics of the planar antenna shown in FIG. 12A.

Further, as shown in FIG. 12A, when the areas of the cut-out parts 52 and 53 of the planar antenna are configured to be 9/4 of the area of the antenna unit 10, the sidelobe characteristics shown in FIG. 12B are obtained. That is, in this case, the sidelobe on the low angle side rises and the characteristics deteriorate. This is caused by the reduced area of the planar antenna.

In this example, when one side of the antenna unit 10 (square) is considered to be 1, one side of the cut-out parts 52 and 53 (squares) is 1.5. In other words, each of the cut-out parts 52 and 53 has an area ¼ of the area of the square composed of nine antenna units 10 that are arranged.

Based on the results shown in FIGS. 11B and 12B, it is preferable to configure the planar antenna according to this embodiment in such a way that the areas of the cut-out parts 52 and 53 (second squares) will each become 1/36 or greater and 1/9 or less of the area of the square (first square) composed of nine antenna units 10 that are arranged. An upper limit value of the area of each of the cut-out parts 52 and 53 corresponds to the area of one antenna unit 10.

Figure 13A:
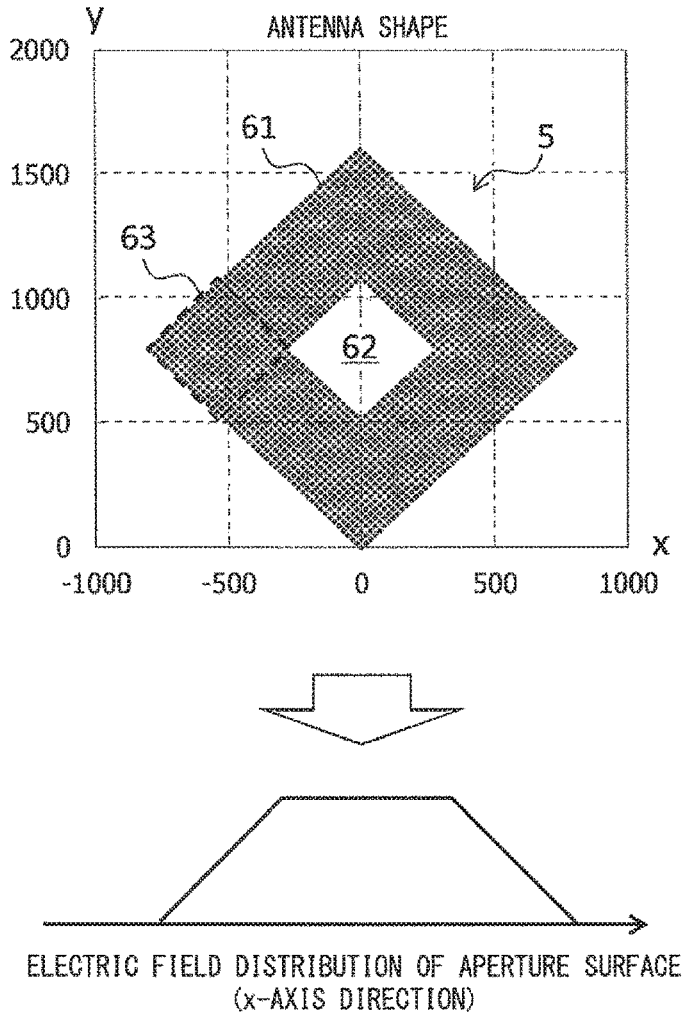
FIG. 13A is a drawing showing a shape of the planar antenna and an electric field distribution of an aperture surface of the planar antenna.

Further, in this embodiment, as shown in FIG. 13A, a planar antenna 5 may be configured in a shape in which a central part of a rectangle 61 is hollowed out by a square 62. In other words, the planar antenna 5 may have a shape in which the central part of the rectangle 61 is hollowed out by the rectangle 62 that has a shape similar to that of the rectangle 61. At this time, diagonal lines of the rectangle 61 are made parallel to the x-axis direction and y-axis direction, respectively. Also in this case, the planar antenna 5 may be composed by combining a plurality of square antenna units on which a plurality of antenna elements are arranged. For example, the planar antenna 5 may be composed by arranging eight antenna units 63 on four sides of a square.

Figure 13B:
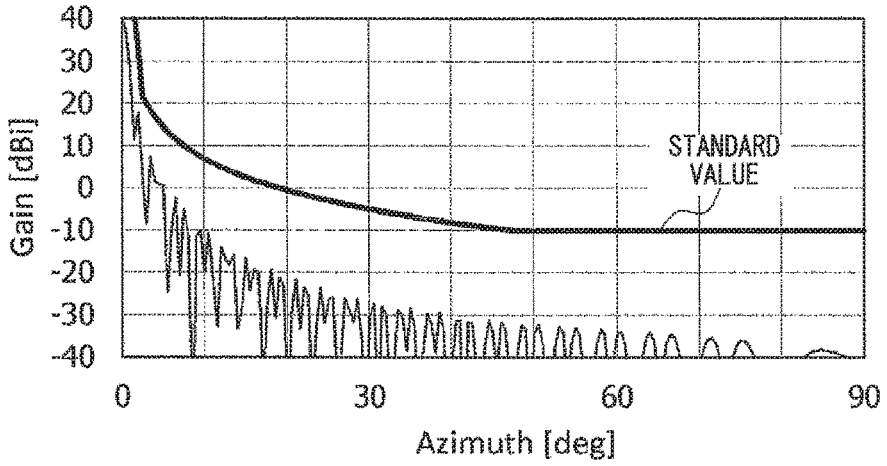
FIG. 13B is a drawing showing sidelobe characteristics of the planar antenna shown in FIG. 13A.

As shown in FIG. 13A, the electric field distribution (x-axis direction) of the aperture surface of the planar antenna becomes low at both ends in the x-axis direction. As for the sidelobe characteristics shown in FIG. 13B, the gain is lower than the standard value at radiation angles from 0 to 90 degrees. Therefore, good sidelobe characteristics are obtained. Since the central part of the planar antenna 5 shown in FIG. 13A is hollowed out in a rectangular shape, mechanical parts and a wireless device can be stored in this hollowed part.

Next, a comparative example of the present invention will be described.

Figure 14A:
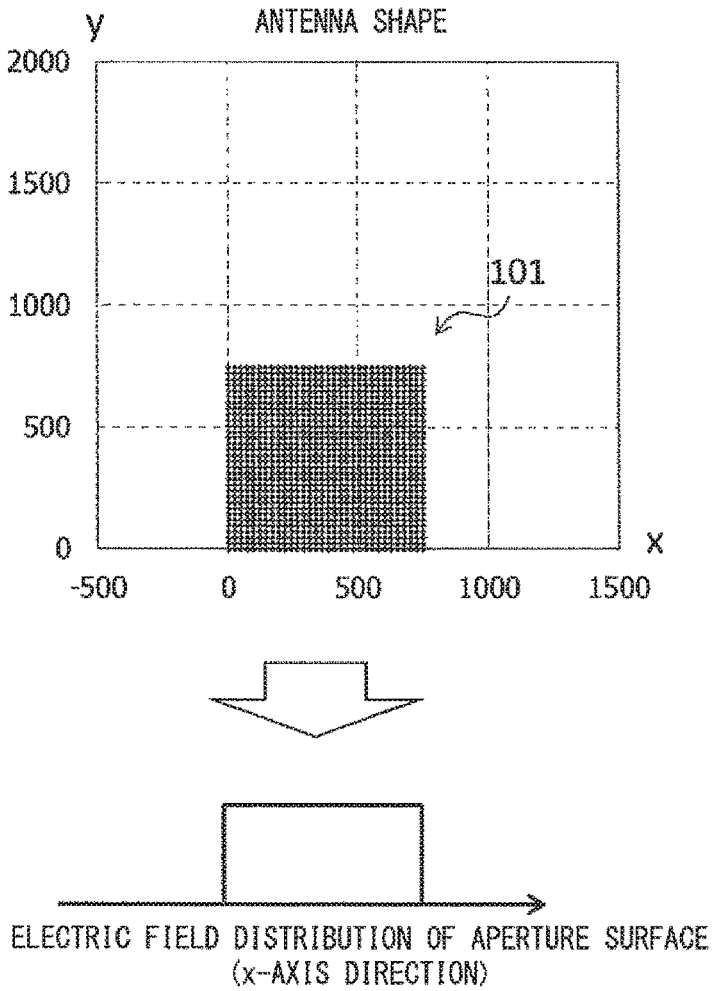
FIG. 14A is a drawing showing a shape of the planar antenna and an electric field distribution of an aperture surface of the planar antenna.
Figure 14B:
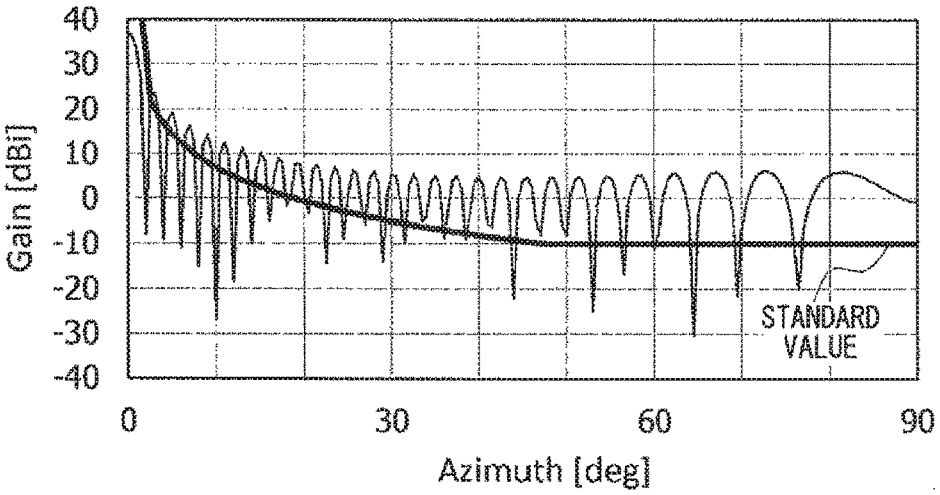
FIG. 14B is a drawing showing sidelobe characteristics of the planar antenna shown in FIG. 14A.

In the case of a planar antenna 101 shown in FIG. 14A, that is, in the case where respective sides of the rectangular planar antenna 101 are arranged to be parallel to the x-axis direction and y-axis direction, respectively, the electric field distribution of the aperture surface of the planar antenna x-axis direction) has a rectangular shape. That is, the electric field distribution of the aperture surface becomes high at both ends in the x-axis direction. In this case, as shown in FIG. 14B, the gain exceeds the standard value at radiation angles from 0 to 90 degrees. Therefore, the sidelobe characteristics deteriorate as a whole.

Figure 15A:
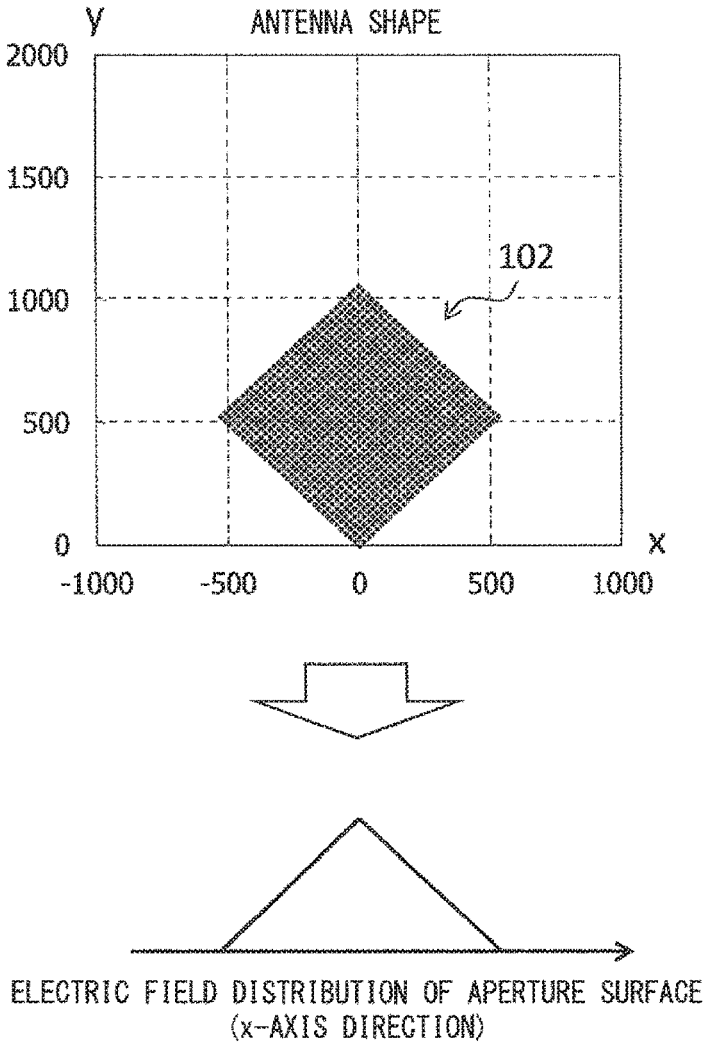
FIG. 15A is a drawing showing a shape of the planar antenna and an electric field distribution of an aperture surface of the planar antenna.
Figure 15B:
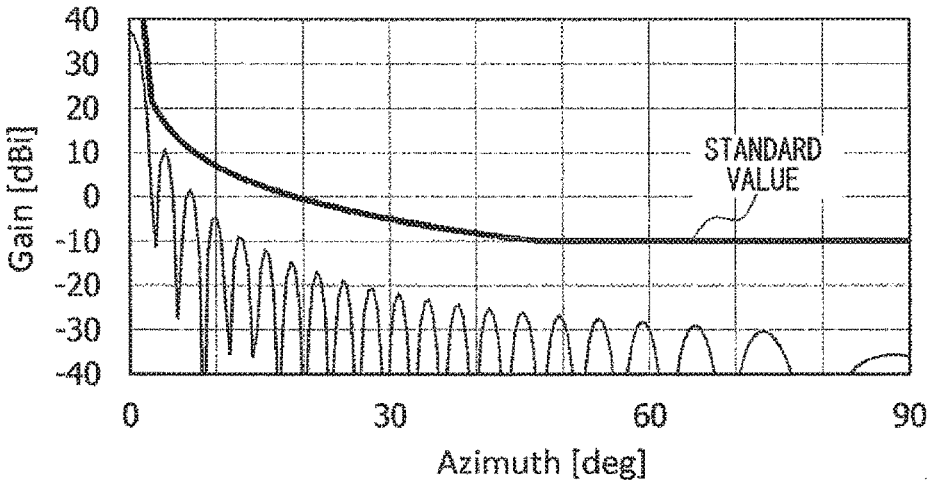
FIG. 15B is a drawing showing sidelobe characteristics of the planar antenna shown in FIG. 15A.

In the case of a planar antenna 102 shown in FIG. 15A, that is, in a case where respective diagonal lines of the rectangular planar antenna 102 are arranged to be parallel to the x-axis direction and y-axis direction, respectively, the electric field distribution of the aperture surface of the planar antenna (x-axis direction) becomes low at both ends in the x-axis direction. As for the sidelobe characteristics shown in FIG. 15B, the gain is lower than the standard value at radiation angles from 0 to 90 degrees. Therefore, good sidelobe characteristics are obtained. The shape of the planar antenna shown in FIG. 15A corresponds to the shape of the planar antenna 1 according to this embodiment before the cut-out parts 12 are 13 are provided. In the case of the planar antenna shown in FIG. 15A, the gain of the planar antenna is discrete, and thus the problem of the present invention described above cannot be solved.

Figure 16A:
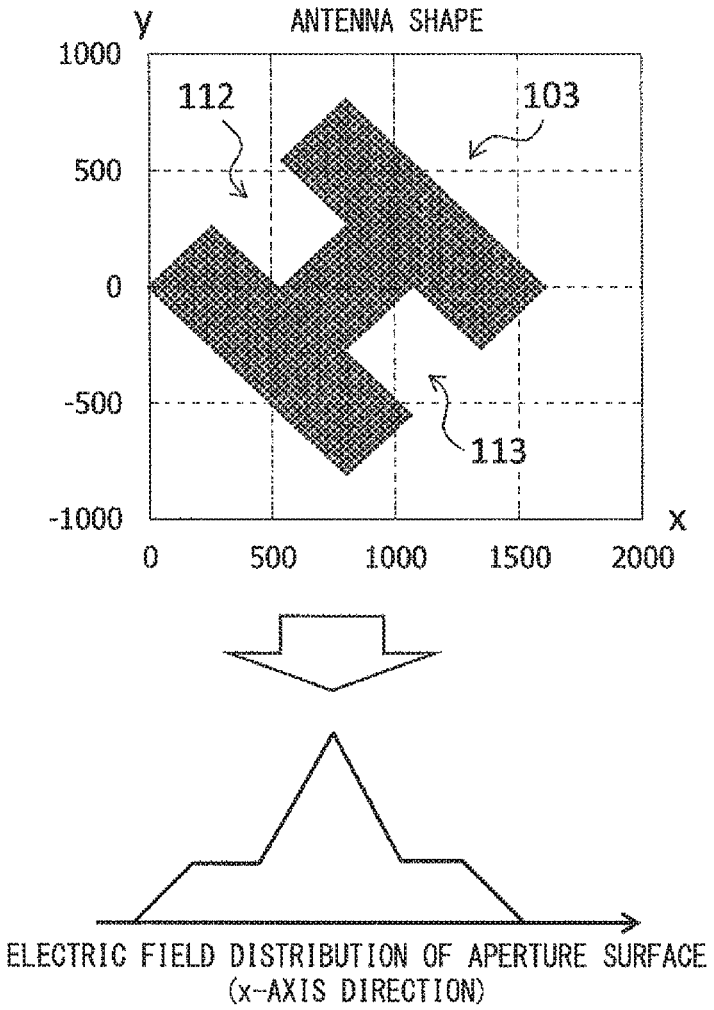
FIG. 16A is a drawing showing a shape of the planar antenna and an electric field distribution of an aperture surface of the planar antenna.
Figure 16B:
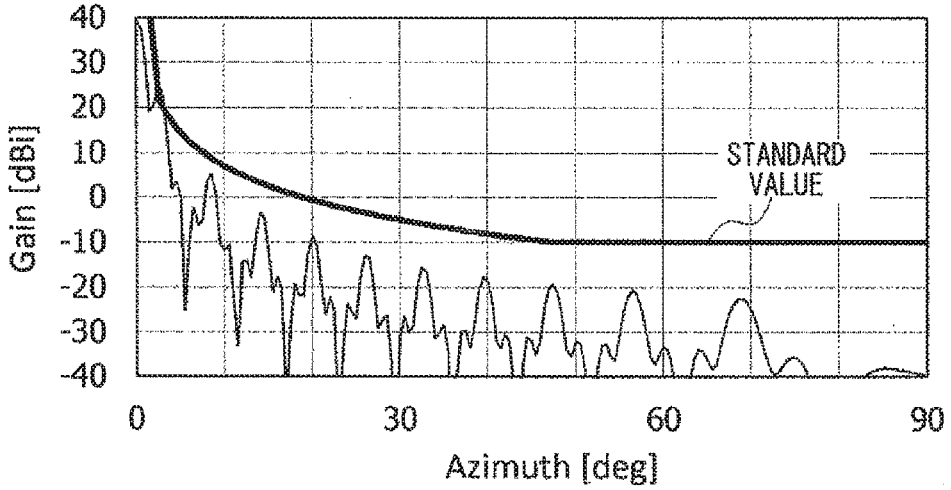
FIG. 16B is a drawing showing sidelobe characteristics of the planar antenna shown in FIG. 16A.

In a planar antenna 103 shown in FIG. 16A, instead of providing cut-out parts on corners of a rectangle, cut-out parts 112 and 113 are provided on two opposite sides of a rectangle (rectangle whose respective diagonal lines are arranged to be parallel to the x-axis direction and y-axis direction, respectively). In this case, the electric field distribution (x-axis direction) of the aperture surface of the planar antenna becomes high at the center. As for the sidelobe characteristics, as shown in FIG. 16B, the gain exceeds the standard value on the low angle side, and the sidelobe is high as a whole. Therefore, the planar antenna 103 does not have sufficient sidelobe characteristics.

Figure 17A:
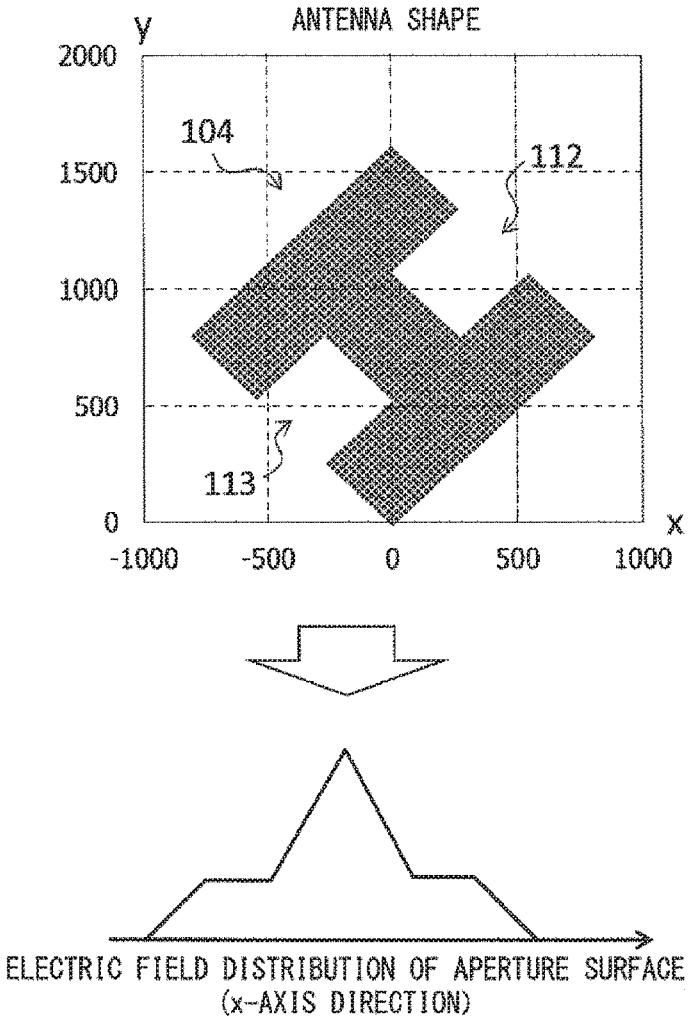
FIG. 17A is a drawing showing a shape of the planar antenna and an electric field distribution of an aperture surface of the planar antenna.
Figure 17B:
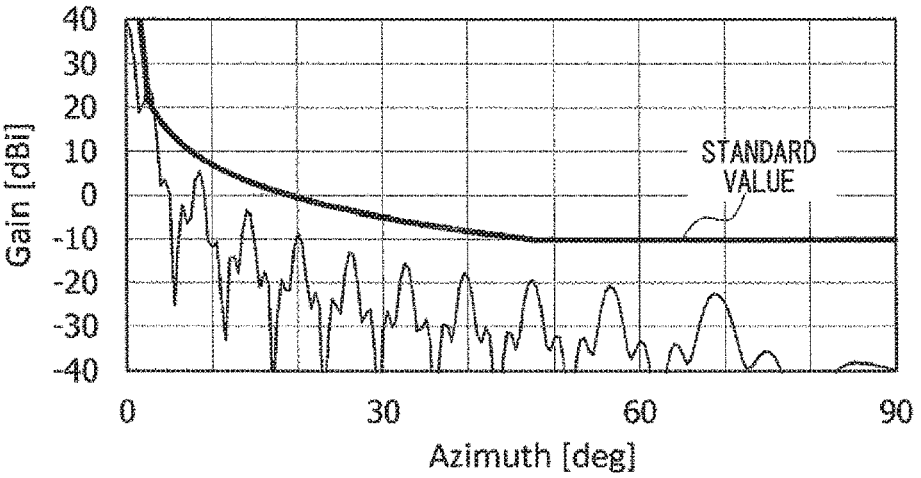
FIG. 17B is a drawing showing sidelobe characteristics of the planar antenna shown in FIG. 17A.

In a planar antenna 104 shown in FIG. 17A, cut-out parts 112 and 113 are provided on two opposite sides of a rectangle (rectangle whose respective diagonal lines are arranged to be parallel to the x-axis direction and y-axis direction, respectively) (i.e., the shape is symmetrical with the shape shown in FIG. 16A with respect to the y-axis). In this case, the electric field distribution (x-axis direction) of the aperture surface of the planar antenna becomes high at the center. As for the sidelobe characteristics, as shown in FIG. 17B, the gain exceeds the standard value on the low angle side, and the sidelobe is high as a whole. Therefore, the planar antenna 104 does not have sufficient sidelobe characteristics.

Figure 18A:
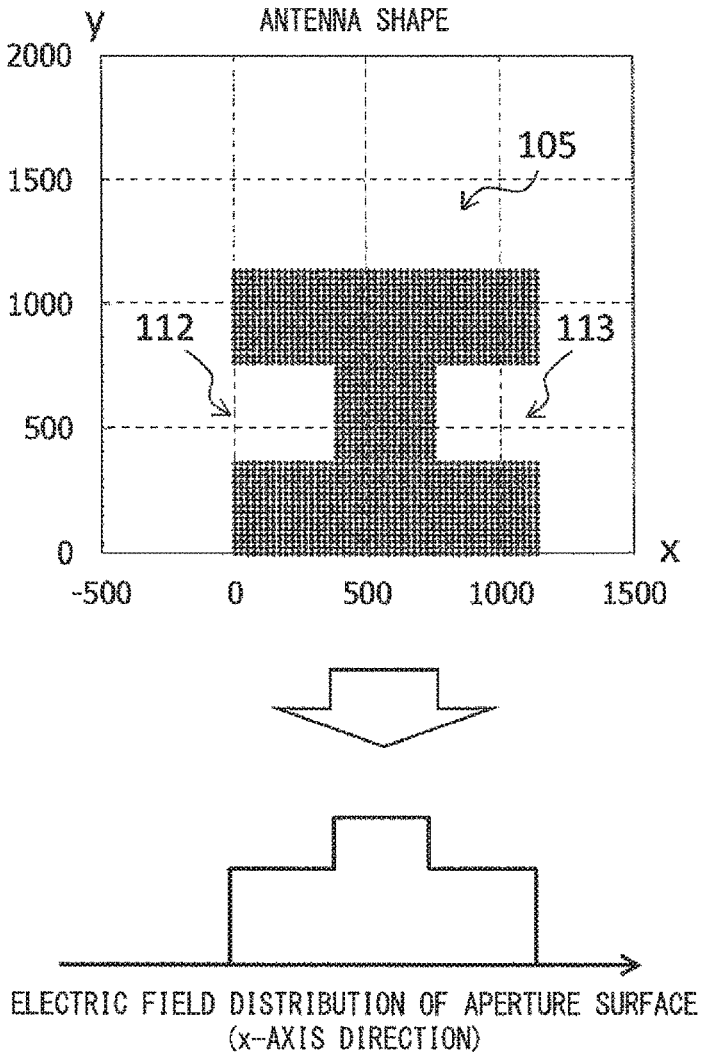
FIG. 18A is a drawing showing a shape of the planar antenna and an electric field distribution of an aperture surface of the planar antenna.
Figure 18B:
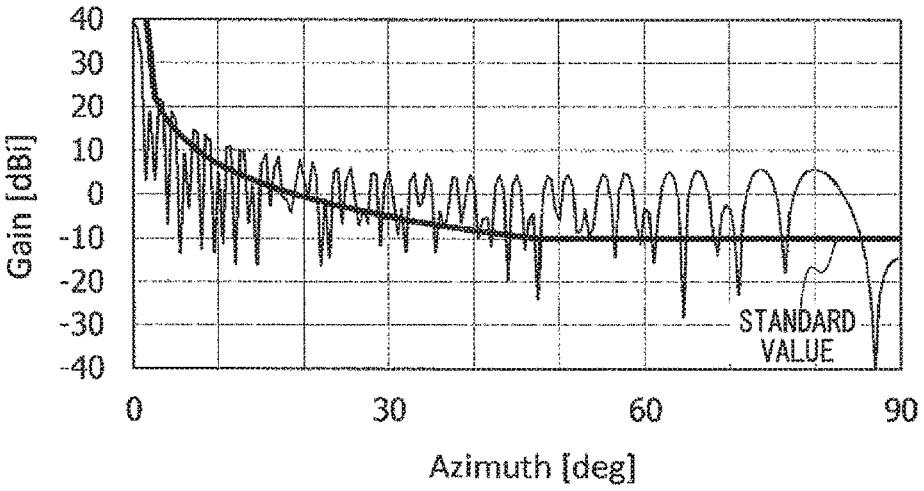
FIG. 18B is a drawing showing sidelobe characteristics of the planar antenna shown in FIG. 18A.

In a planar antenna 105 shown in FIG. 18A, cut-out parts 112 and 113 are provided on right and left sides of a rectangle (rectangle whose respective sides are arranged to be parallel to the x-axis direction and y-axis direction). In this case, the electric field distribution (x-axis direction) of the aperture surface of the planar antenna becomes high at both ends and at the center in the x-axis direction. As for the sidelobe characteristics, as shown in FIG. 18B, the gain exceeds the standard value as a whole, and the sidelobe characteristics deteriorate to worse than the cases shown in FIGS. 16B and 17B.

Figure 19A:
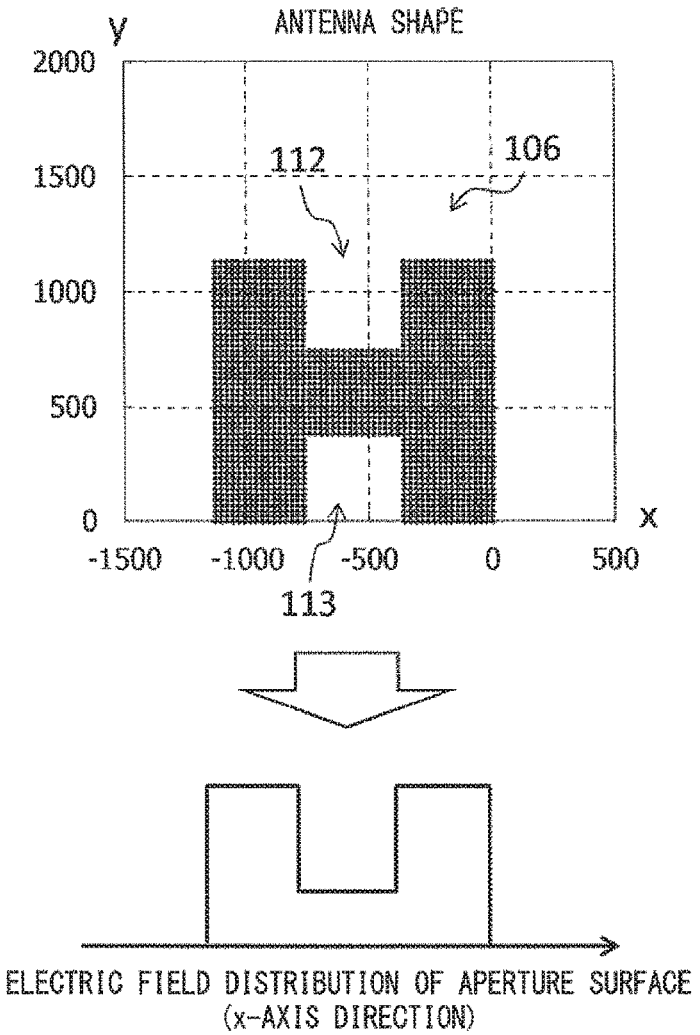
FIG. 19A is a drawing showing a shape of the planar antenna and an electric field distribution of an aperture surface of the planar antenna.
Figure 19B:
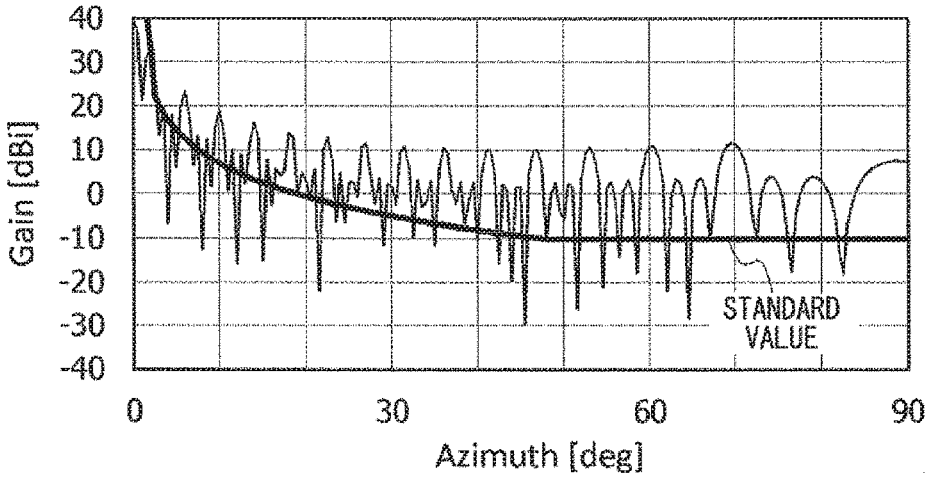
FIG. 19B is a drawing showing sidelobe characteristics of the planar antenna shown in FIG. 19A.

In a planar antenna 106 shown in FIG. 19A, cut-out parts 112 and 113 are provided on upper and lower sides of a rectangle (rectangle whose respective sides are arranged to be parallel to the x-axis direction and y-axis direction). In this case, the electric field distribution (x-axis direction) of the aperture surface of the planar antenna becomes high at both ends and at the center in the x-axis direction. As for the sidelobe characteristics, as shown in FIG. 19B, the gain exceeds the standard value as a whole, and the sidelobe characteristics deteriorate to worse than the case shown in FIG. 18B.

Figure 20A:
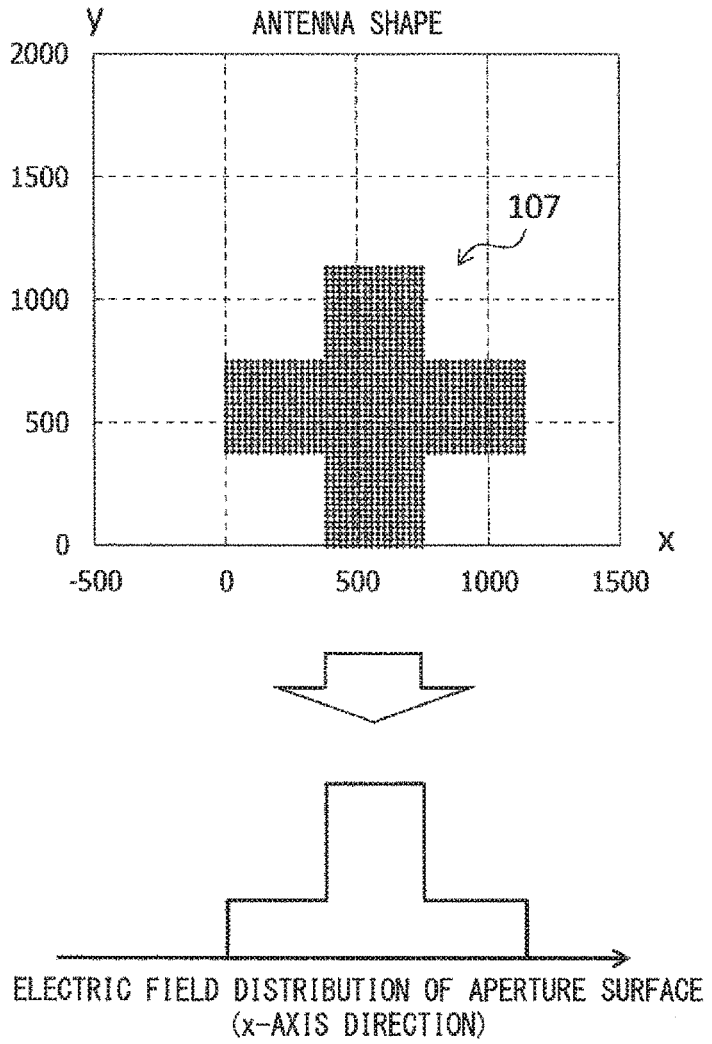
FIG. 20A is a drawing showing a shape of the planar antenna and an electric field distribution of an aperture surface of the planar antenna.
Figure 20B:
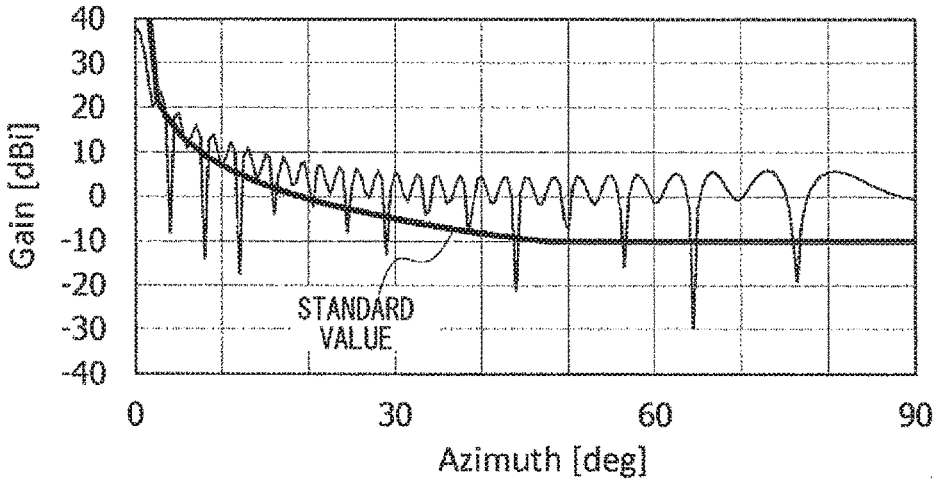
FIG. 20B is a drawing showing sidelobe characteristics of the planar antenna shown in FIG. 20A.

In a planar antenna 107 shown in FIG. 20A, a shape of the planar antenna is configured in a cross shape. In other words, all four corner parts of a rectangle (rectangle whose respective sides are arranged to be parallel to the x-axis direction and y-axis direction) are cut out. In this case, the electric field distribution (x-axis direction) of the aperture surface of the planar antenna becomes high at the center in the x-axis direction. As for the sidelobe characteristics, as shown in FIG. 20B, the gain exceeds the standard value as a whole, and the sidelobe characteristics are not good.

Figure 21A:
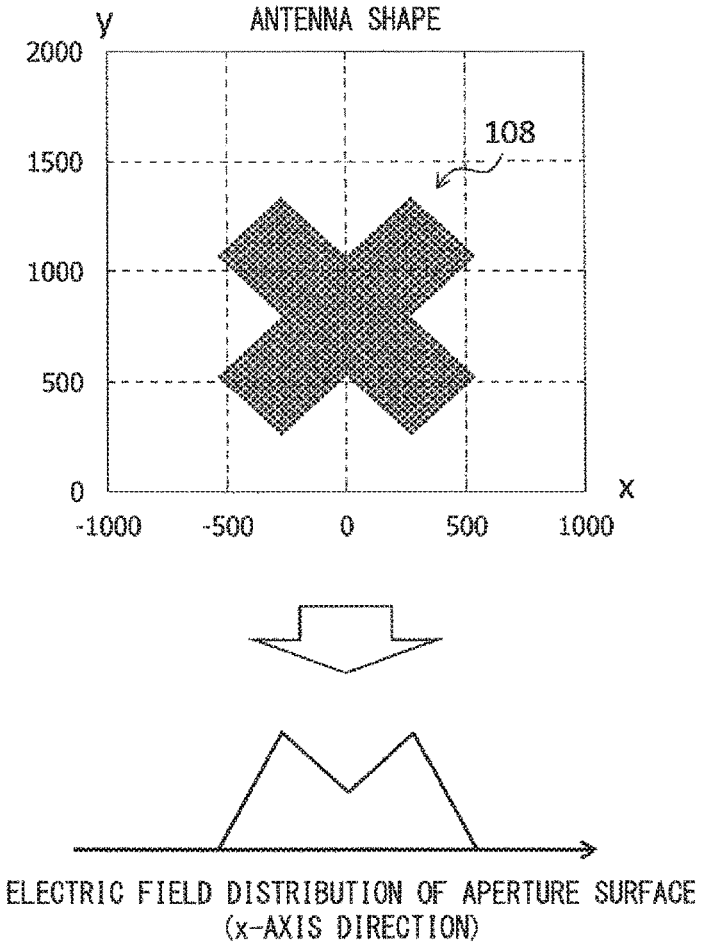
FIG. 21A is a drawing showing a shape of the planar antenna and an electric field distribution of an aperture surface of the planar antenna.
Figure 21B:
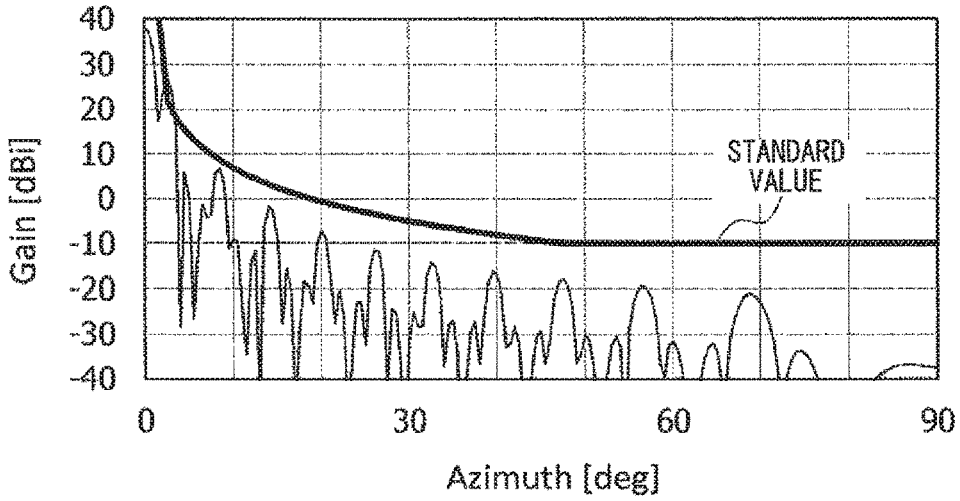
FIG. 21B is a drawing showing sidelobe characteristics of the planar antenna shown in FIG. 21A.

In a planar antenna 108 shown in FIG. 21A, a shape of the planar antenna is configured in a cross shape (shape obtained by rotating the planar antenna 107 shown in FIG. 20A by 45 degrees). In this case, the electric field distribution (x-axis direction) of the aperture surface of the planar antenna becomes high at two points in the x-axis direction. As for the sidelobe characteristics, as shown in FIG. 21B, the gain becomes high as a whole, and good sidelobe characteristics cannot be obtained. Note that the shape of the planar antenna 108 can be expressed in other words as a shape in which all four corner parts of a rectangle (rectangle whose respective diagonal lines are arranged to be parallel to the x-axis direction and y-axis direction, respectively) are cut out.

Figure 22A:
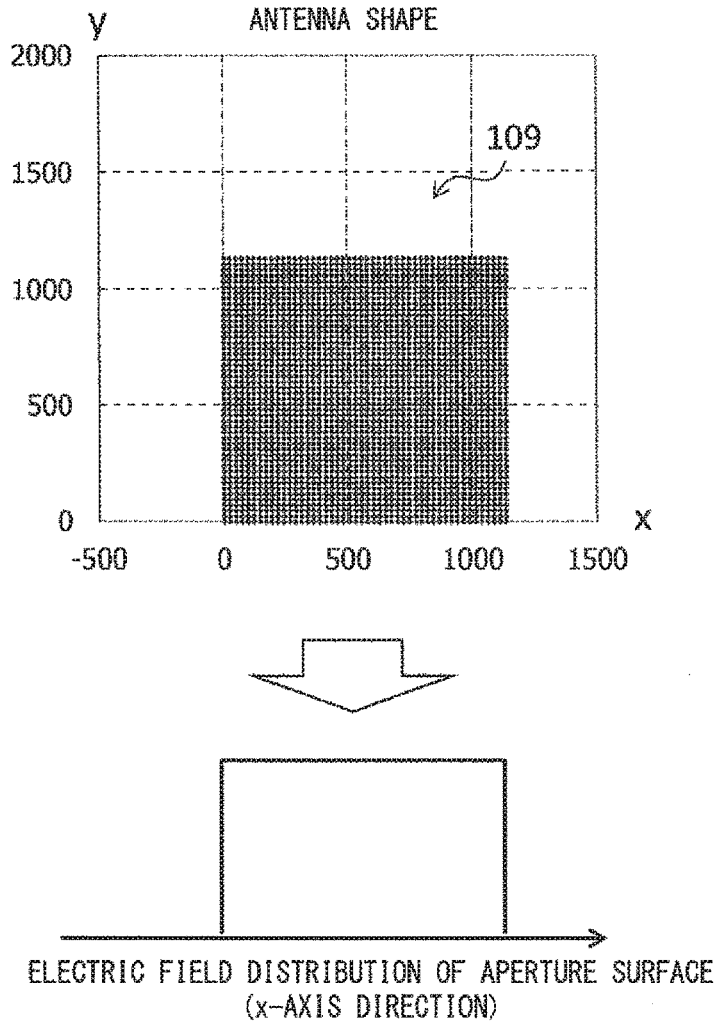
FIG. 22A is a drawing showing a shape of the planar antenna and an electric field distribution of an aperture surface of the planar antenna.

In the case of a planar antenna 109 shown in FIG. 22A, that is, in the case where respective sides of the rectangular planar antenna 109 are arranged to be parallel to the x-axis direction and y-axis direction, respectively, the electric field distribution of the aperture surface of the planar antenna (x-axis direction) has a rectangular shape. That is, the electric field distribution of the aperture surface becomes high at both ends in the x-axis direction. Note that the shape of the planar antenna 109 shown in FIG. 22A corresponds to the shape of the planar antenna 101 shown in FIG. 14A with an increased area.

Figure 22B:
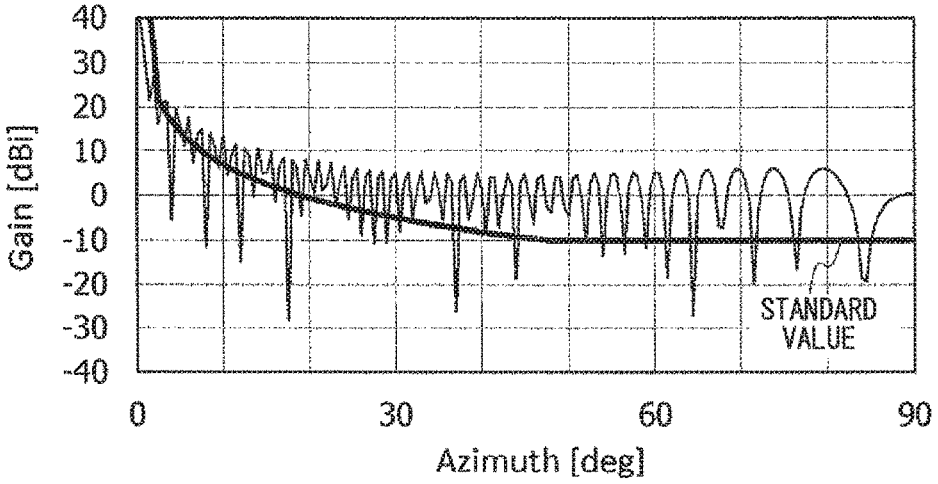
FIG. 22B is a drawing showing sidelobe characteristics of the planar antenna shown in FIG. 22A.

In this case, as shown in FIG. 22B, the gain exceeds the standard value at radiation angles from 0 to 90 degrees. Therefore, the sidelobe characteristics deteriorate as a whole. As shown in FIG. 22B, as for the sidelobe characteristics of the planar antenna 109, a null pitch becomes narrower than the sidelobe characteristics of the planar antenna 101 shown in FIG. 14A, but the envelopes are almost the same as those in FIG. 14A. Moreover, the main beams are thin.

Figure 23A:
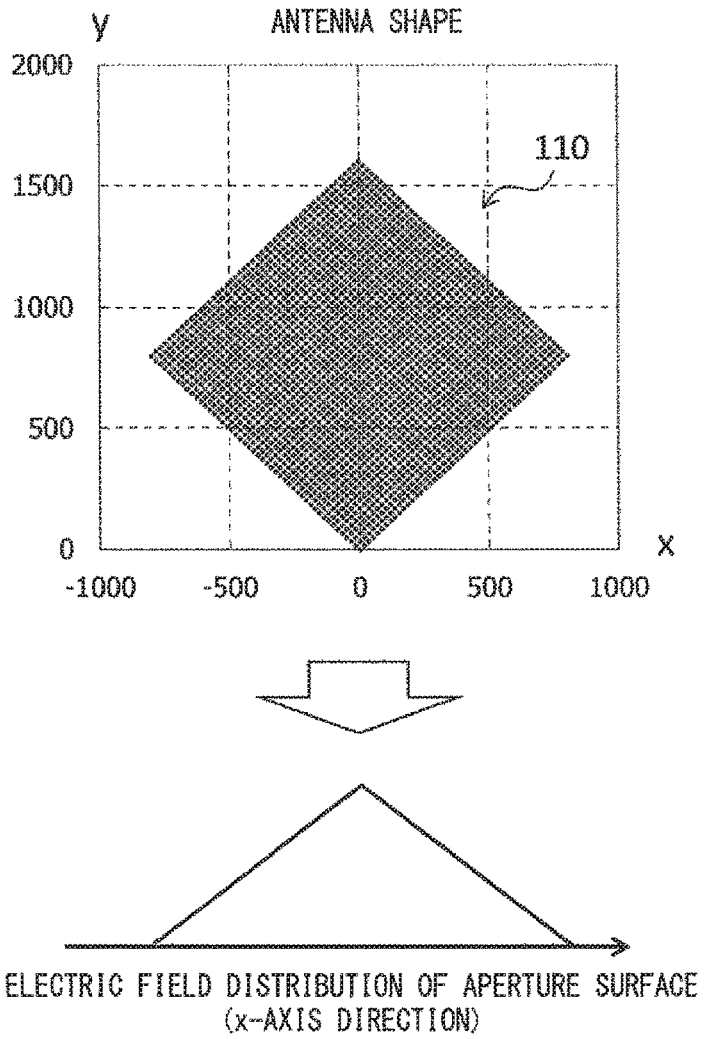
FIG. 23A is a drawing showing a shape of the planar antenna and an electric field distribution of an aperture surface of the planar antenna.

In the case of a planar antenna 110 shown in FIG. 23A, that is, in a case where respective diagonal lines of the rectangular planar antenna 110 are arranged to be parallel to the x-axis direction and y-axis direction, respectively, the electric field distribution of the aperture surface of the planar antenna (x-axis direction) becomes low at both ends in the x-axis direction. The shape of the planar antenna 110 shown in FIG. 23A corresponds to the shape of the planar antenna 102 shown in FIG. 15A with an increased area.

Figure 23B:
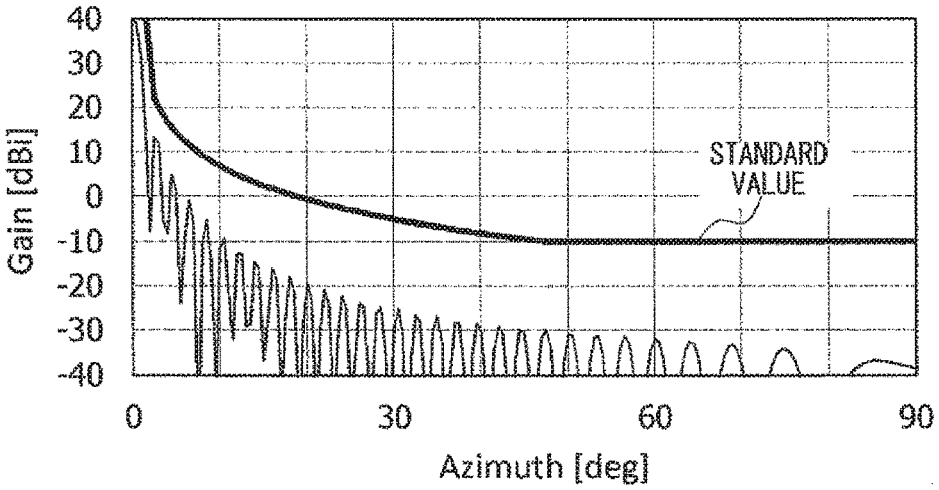
FIG. 23B is a drawing showing sidelobe characteristics of the planar antenna shown in FIG. 23A.

In this case, as shown in FIG. 23B, the gain is lower than the standard value at radiation angles from 0 to 90 degrees. Therefore, good sidelobe characteristics are obtained. The shape of the planar antenna shown in FIG. 23A corresponds to the shape of the planar antenna 1 according to this embodiment before the cut-out parts 12 are 13 are provided. In the case of the planar antenna shown in FIG. 23A, the gain of the planar antenna is discrete, and thus the problem of the present invention described above cannot be solved.

Although the present invention has been described with reference to the embodiments, the present invention is not limited by the above. Various modifications and changes, understood by those skilled in the art within the scope of the present invention, can be made to the configurations and details of the present invention.

The present application is based upon and claims the benefit of priority from Japanese Patent Application No. 2014-214459, filed on Oct. 21, 2014, the entire contents of which are hereby incorporated by reference.

REFERENCE SIGNS LIST

1, 2, 3, 4, 5 PLANAR ANTENNA
10 ANTENNA UNIT
11 RECTANGLE
12, 13, 17, 18 CUT-OUT PART
21 FIRST UNIT
22 SECOND UNIT
30, 35 ANTENNA UNIT
31 DIELECTRIC SUBSTRATE
32 ANTENNA ELEMENT
33, 44, 45, 46 MICROSTRIP LINE (FEEDER CIRCUIT)
36, 41, 42 CONTACT POINT
43 FEEDING POINT

The invention claimed is:

1. A planar antenna including a plurality of individual antenna units arranged in a planar array antenna area, wherein two opposite corner parts from among corners of an N-gon (N is an even number equal to or greater than four) of the planar array antenna area include an area where the antenna units are not arranged, wherein, the planar array antenna area is composed by combining a plurality of square antenna unit areas on which the plurality of antenna units are arranged, wherein, the planar array antenna area comprises a first unit composed of four of the antenna unit areas arranged in a square and a second unit composed of three of the antenna unit areas arranged in an L shape, and the second unit area is arranged in such a way that a recessed part of the second unit area is joined with one of corner parts of the first unit area.

2. The planar antenna according to claim 1, wherein the area in which the antenna units are arranged in the planar array antenna area has a shape in which the two opposite corner parts from among four corner parts included in a first square are cut out in second squares, respectively, and the second square has an area 1/36 or greater and 1/9 or less of an area of the first square.

3. A planar antenna on which a plurality of antenna elements are arranged, wherein the planar antenna has a shape in which a central part of a rectangle is hollowed out by a rectangle.

4. The planar antenna according to claim 3, wherein the planar antenna has a shape in which the central part of the rectangle is hollowed out by a rectangle that has a shape similar to that of the rectangle.

5. The planar antenna according to claim 3, wherein the planar antenna is composed by combining a plurality of square antenna units on which the plurality of antenna elements are arranged.

* * * * *